US012759036B2

(12) United States Patent
Haar

(10) Patent No.: US 12,759,036 B2
(45) Date of Patent: Oct. 13, 2026

(54) METHOD FOR FORMING A DEEP DRAW CLOSURE CAP

(71) Applicant: Saeta GmbH & Co. KG, Wedel (DE)

(72) Inventor: Thomas Haar, Halstenbek (DE)

(73) Assignee: SAETA GMBH & CO. KG, Wedel (DE)

( * ) Notice: Subject to any disclaimer, the term of this patent is extended or adjusted under 35 U.S.C. 154(b) by 323 days.

(21) Appl. No.: 17/618,937

(22) PCT Filed: May 13, 2020

(86) PCT No.: PCT/EP2020/063318
§ 371 (c)(1),
(2) Date: Dec. 14, 2021

(87) PCT Pub. No.: WO2020/249351
PCT Pub. Date: Dec. 17, 2020

(65) Prior Publication Data

US 2022/0305542 A1 Sep. 29, 2022

(30) Foreign Application Priority Data

Jun. 14, 2019 (EP) ..... 19180215

(51) Int. Cl.
*B21D 22/28* (2006.01)
*B21D 51/44* (2006.01)

(52) U.S. Cl.
CPC ..... *B21D 22/28* (2013.01); *B21D 51/443* (2013.01)

(58) Field of Classification Search
CPC ..... B21D 22/24; B21D 22/28; B21D 24/16; B21D 51/44; B21D 51/443; B21D 22/22; B21D 37/18; B21D 51/48; B21D 51/50
See application file for complete search history.

(56) References Cited

U.S. PATENT DOCUMENTS 2,024,262 A * 12/1935 Williams ..... B21D 51/50 72/703
3,352,268 A * 11/1967 Koll ..... B65D 41/3485 83/879
3,824,941 A * 7/1974 Hannon ..... B21D 51/50 413/10
4,256,234 A 3/1981 Mori et al.
(Continued)

FOREIGN PATENT DOCUMENTS

CA 3139368 A1 11/2020
EP 0118926 A2 9/1984
EP 0664169 A1 7/1995

OTHER PUBLICATIONS

EP 2848331A1, Lattner Mar. 2015.*
(Continued)

*Primary Examiner* — Edward T Tolan
(74) *Attorney, Agent, or Firm* — Barclay Damon LLP

(57) ABSTRACT

A method for forming a deep draw closure cap includes draw forming a first cup from a planar sheet of a metal material defining a base thickness. The first cup comprises a first cup base, a first cup wall, and an open end. A first redrawing of the first cup is performed to form a first redrawn cup including a first redrawn cup base, a first redrawn cup wall, and an open end. The first redrawn cup is passed through an ironing die to reduce a thickness of the first redrawn cup wall adjacent to the open end.

17 Claims, 16 Drawing Sheets

(56) References Cited

U.S. PATENT DOCUMENTS 4,291,567 A * 9/1981 Murayama ..... B65D 51/145 72/347
4,369,643 A * 1/1983 Cianciolo ..... B24B 39/00 29/90.01
4,412,440 A 11/1983 Phalin et al.
4,416,142 A * 11/1983 Thorne-Thomsen .. B21D 51/50 470/84
4,462,235 A * 7/1984 King ..... B21D 17/04 72/115
4,522,049 A * 6/1985 Clowes ..... B21D 22/30 72/46
4,696,177 A * 9/1987 Bulso, Jr. ..... B21D 51/26 413/69
4,711,611 A * 12/1987 Bachmann ..... B21D 51/26 413/69
4,962,659 A * 10/1990 Imazu ..... B21D 22/201 72/349
5,012,942 A * 5/1991 Druesne ..... B65D 41/62 215/253
5,168,742 A * 12/1992 Heyes ..... B21D 22/30 72/347
5,271,258 A 12/1993 Bernier et al.
5,433,099 A * 7/1995 Katsuhiro ..... B21D 24/12 72/347
5,575,400 A * 11/1996 Turner ..... B21D 35/006 220/604
6,010,026 A 1/2000 Diekhoff et al.
6,403,173 B1 * 6/2002 Granger ..... B65D 41/0492 428/458
6,634,203 B1 * 10/2003 Ras ..... B21D 22/28 413/69
9,283,611 B2 * 3/2016 Haar ..... B21D 22/22
9,375,774 B1 6/2016 Watkins et al.
10,500,626 B2 * 12/2019 Nakamura ..... B21D 22/21
2005/0126247 A1 * 6/2005 Hepner ..... B21D 51/24 72/342.3
2010/0282707 A1 * 11/2010 Granger ..... B67B 3/12 215/347
2017/0283126 A1 10/2017 Laszcyk et al.
2022/0324010 A1 * 10/2022 Stoppiglia ..... B21D 51/50

OTHER PUBLICATIONS

GB 1598428A, Mackenzie Sep. 1981.*
CNIPA, Office Action from Chinese Patent Application No. CN202080043733.7 with English language translation mailed Apr. 15, 2023 (total 11 pages).
IP Australia, Office Action/Search Report from Australian Patent Application No. AU mailed Jun. 5, 2023 (total 3 pages).
PCT/EP2020/063318; International Search Report and Written Opinion; date of mailing Jun. 9, 2020 (11 pages).
CNIPA, Office Action from Chinese Patent Application No. CN202080043733.7 with English language translation mailed Apr. 15, 2023 (total pages).
IP Australia, Office Action/Search Report from Australian Patent Application No. AU mailed Jun. 5, 2023 (total pages).
Canadian Patent Office; Canadian Office Action; Application No. 3,143,091; dated Nov. 26, 2024; 5 pages.

* cited by examiner

DETAIL D

METHOD FOR FORMING A DEEP DRAW CLOSURE CAP

CROSS REFERENCE TO RELATED INVENTION

This application is a national stage application pursuant to 35 U.S.C. § 371 of International Application No. PCT/EP2020/063318, filed on May 13, 2020, which claims priority to, and benefit of, European Patent Application No. 19180215.6, filed Jun. 14, 2019, the entire contents of which are hereby incorporated by reference.

TECHNOLOGICAL FIELD

This disclosure relates to a method for forming a deep draw closure cap.

BACKGROUND

Caps for containers are typically formed from blanks punched from sheet metal and can be formed in a drawing operation wherein a punch tool draws the material of the blank through a die to form a closure having a base and a cylindrical wall extending to an open, outer end. As the material is drawn through the die, the material toward the outer end is compressed to form the diameter of the wall.

In draw-redraw processes, the material provided by a blank can be formed into shells or cups in successive steps in a material forming reduction process where the diameter of the shell or cup is reduced and the height of the cylindrical wall increases at each step. As the material passes through the successive dies, the thickness of the material defining the wall tends to increase as it passes over the die such that a non-uniform thickness is defined in the wall along its axial length. Further, as the material passes through the die, it is compressed and mechanically worked and a directional orientation of the material is defined by the grain of the material, which can result in projections in the form of earing or scuffing being formed in the edge defined by the open, outer end of the shell. Such projections during formation of the shell are considered to be waste material that needs to be trimmed from the outer end to provide the shell as a finished product.

Hence, in a deep draw process where the final height of the wall of a shell or cup is substantially greater than the diameter, substantial working of the material may be required to obtain the desired dimensions of wall height and wall thickness, and there is a continuing need to reduce the effects of mechanical work applied to the material to minimize waste, while still producing the desired dimensions, such as for thin-wall deep drawn shells.

In some applications, such as food and beverage packaging, coatings may be applied to the material before the draw-redraw process to form the shell, wherein application of the coating can provide corrosion protection to the material. Lacquer coating is a well-known conventional or traditional coating material that can be applied as a solution through various processes to form a layer on the material surface. In a typical application process for lacquer coatings, a lacquer coating solution is applied to the material and a solvent in the solution may be removed by evaporation, which may be accelerated by heating the material. In some cases, a coating may be applied both prior to the metal forming operation and following the metal forming operation, as a restorative step to replace damaged coating. It is desirable to maintain the integrity of the lacquer coating once it is applied to the material to maintain uniformity of the coating and to avoid additional process time and expense associated with reapplication of the coating.

As an alternative to lacquer coating, laminate coatings have been developed wherein a film, such as may be formed, for example, by a precast or blown polymer material, can be applied to the surface of the material without use of solvents, comprising an environmentally friendly coating. Also, laminate coatings can provide greater resistance to damage during material forming operations. However, laminate coatings can be more expensive than traditional lacquer coatings and there is a limit to the minimum film thickness that can be effectively applied to a surface. Hence, in many applications it is still desirable to utilize traditional lacquer coatings, i.e., non-laminate coatings, as a surface protecting coating.

Additionally, for deep drawn shells that are formed of material having a coating, such as a corrosion resistant coating or film material, it is desirable to control the formation of the blank material such that the coating remains intact through all portions of the material forming process. For example, if the material is subjected to elevated pressures as it passes into or through a draw die, fine pieces of fluff or hair-like formations can be formed on the open, outer edge of the deep drawn shell, which can soil the die and interfere with proper draw forming operations and can contaminate the final product defined by the shell.

In a particular form or category of caps, commonly referred to as pilfer proof caps, a deep drawn cap is formed for positioning over the upper end of a bottle such as, for example, a wine bottle. The pilfer proof cap typically includes a closed end portion including a "thread portion" that can overlap threads of a bottle and be compressed onto and conform to the bottle threads. A score adjacent to the thread portion of the cap defines a frangible portion of the cap that can break when the bottle is opened, wherein the score connects the thread portion to a skirt portion of the cap extending below the thread portion. The skirt portion may provide a location for printing of label indicia. Generally, draw/redraw processes performed for forming pilfer proof caps are directed to ensuring correct formation of the cap such as to provide a material thickness that permits the cap to conform to underlying bottle threads. This necessitates substantial material thicknesses of the cap. Considering the large number of such caps being produced today it would be desirable to reduce the material used for a given cap.

Starting from the prior art it is an object of the invention to provide a method of the above mentioned type that allows for the production of caps, for example pilfer proof caps, which reliably meet the functional requirements, for example conform to underlying bottle threads, while minimizing the material needed.

BRIEF SUMMARY OF THE INVENTION

An embodiment of a method of forming a deep draw closure cap is provided. The method includes draw forming a first cup from a planar sheet of metal material defining a base thickness, where the first cup includes a first cup base, a first cup wall, and an open end. A first redrawing of the first cup is performed to form a redrawn cup having a redrawn cup base, a redrawn cup wall, and an open end. The material is passed through an ironing die, wherein the ironing die reduces the thickness of the redrawn cup wall at least adjacent to the open end.

The deep draw closure cap formed may be a cap for positioning over the upper end of a bottle such as, for example, a beverage bottle, such as a wine or liquor bottle. The cap may be a so-called pilfer proof cap. According to an embodiment, a first cup is formed from a planar sheet of metal material in a draw forming step. The first cup includes a first cup base, a first cup wall, and an open end. In a following first redrawing performed on the first cup a redrawn cup is formed having a redrawn cup base, a redrawn cup wall, and an open end. The redrawn cup is subsequently passed through an ironing die, wherein the ironing die reduces the thickness of the redrawn cup wall at least in a section of the redrawn cup wall adjacent the open end.

The wall ironing step may occur directly after the first redrawing step. However, further redrawing step(s) may be performed after the first redrawing. In this case it is also possible to carry out the wall ironing step after any of the following redrawing steps, for example after the last redrawing step. For example, exactly one wall ironing step can be carried out. It may be preferred to carry out the wall ironing step after the last redrawing step. This makes the production process easier. However, it is of course also possible to carry out several ironing steps after performing several redrawing steps. For example the material can be subjected to the ironing step after all redrawing steps or after some of the redrawing steps.

The ironing die may be incorporated into the first redraw tooling and/or into one or more subsequent redraw toolings, in particular at least into the last redraw tooling, thus be part of the respective redraw tooling. However, it is of course also possible to provide the ironing die(s) separate from the redraw tooling(s). The ironing step may be an integrated part of the first redrawing step and/or for example one of subsequent redrawing steps, or it may be a separate step. If the ironing step is an integrated part of a redrawing step the ironing step may be effected for example by providing a gap of the redrawing tool narrower than the current material thickness, thus performing the ironing step. The ironing die would then be incorporated by this narrower gap. The ironing die may also be provided as a separate insert stacked on top of the redraw die. This allows for an easy exchange of the ironing die for wear or changing ironing die size quickly. The invention is also generally applicable to different redrawing processes, for example reverse drawing, telescopic drawing, progressive drawing.

In the prior art, the thickness of caps, in particular the thickness of the usually cylindrical wall extending from the base of caps of this type, in particular caps for positioning over the upper end of a bottle, is dictated by the function of the cylindrical wall in particular in a threaded portion to engage a thread on a bottle top. However, it has been found by the present inventors that the usually cylindrical wall extending from the base of the caps can be regarded as having two sections, namely a first, "functional section" comprising for example a thread for engaging a corresponding thread on a bottle top and also holding potential pressure, this functional section being the section adjacent the base of the caps, and a second, "non-functional section" extending from the functional section to the open end of the caps. The functional section requires a certain material thickness to reliably meet the functional requirements of the cap, in particular for securely holding the cap on a bottle top. It has further been found by the present inventors that such requirements do not have to be met by the non-functional section. Rather, this non-functional section, being in particular a skirt section, usually merely serves for imaging and advertising purposes, for example by bearing a printing or the like, with low stability requirements. Consequently, the material thickness of this non-functional section may be reduced and potentially less than that of the functional section, and thus than that of caps of the prior art without jeopardizing the reliable function of the caps. By subjecting the material to a wall ironing process to reduce the thickness of the redrawn cup wall at least adjacent the open end it is thus possible to achieve very substantial material savings without risking the reliable functionality of the caps. In addition, including a wall ironing step in the forming process has no effect on the potential upstream (sheet preparation) and downstream (coating, printing, knurling) process. It can thus be easily integrated into the production lines. The drawing sequence can be left unchanged.

The first cup may have a first cup flange extending laterally from the first cup wall. Also, the redrawn cup may be formed with a flange, for example in case two redraws are required.

According to an embodiment, it is possible that for performing the first redrawing first redraw tooling is provided including a first redraw die, a first redraw pad, and a first redraw punch movable between an extended position cooperating with the first redraw die and a retracted position, a portion of the first cup base is engaged with a predetermined first force between the first redraw pad and the first redraw die, wherein the first redraw pad cooperates with the first redraw die for constraining material of the first cup to bend across a radius of the first redraw die, and the first redraw punch is moved to the extended position to draw material of the first cup through the first redraw die and define the redrawn cup wall.

The draw forming and the first redrawing may further be performed in a reverse-draw method, where the draw forming and the first redrawing are effected in a combined tool. However, a tool for the draw forming and a tool for the first redrawing may also be separate tools.

The first cup may be formed from a coated blank cut from the planar sheet of metal material. According to a further embodiment the material may be aluminum. Such material is often used for caps of this type. The material may include a coating, preferably a traditional lacquer coating before being subjected to the draw forming step, and thus also before being subjected to the first redrawing step. However, the material may also be coating free. A maximum thickness of material passing through the ironing die may be reduced within a range of less than 70%, preferably not more than 50%, further preferably approximately 25%-40%. This reduction is possible without damage to the lacquer coating. It has been found surprisingly that material, such as aluminum, having a coating, such as a lacquer coating, can be subjected to an inventive wall ironing process without critical damage to the coating. Even if the wall ironing process would cause slight stress to the lacquer coating, leading potentially to slight porosity of the coating, this is again not critical if restricted to the non-functional section, where the coating only has decoration purposes. In a traditional draw and wall ironing (DWI) application to form a lacquer coated metal blank, the ironing step can typically reduce the material thickness by approximately 70%, causing substantial damage to a lacquer coating in the process. It is desirable to maintain the integrity of a lacquer coating once it is applied to the material to maintain uniformity of the coating and to avoid additional process time and expense associated with reapplication of the coating. This is achieved with the above explained reduced thickness reductions in the wall ironing step of roughly half (or less) the ironing of a traditional DWI process. This "partial wall ironing" is particularly advantageous for the processing of lacquer coated material.

Subjecting the material, including a coating, preferably a lacquer coating, to the wall ironing process has the additional advantage that no or very little coolant/lubricant, such as oil, is necessary on the surface of the material, unlike in conventional wall ironing processes, where the aluminum is flooded/covered in coolant/oil mixture, commonly at over 70 litres/min, for the wall ironing process. Rather, the lacquer coating provides the necessary lubricating. Conventional oil lubrication, in contrast, has the disadvantage that the oil needs to be fully removed for a subsequent provision of a (lacquer) coating. This leads to extensive additional requirements, such as providing corresponding washers, and can be avoided according to the invention. The restricted lubrication potentially still required in the inventive process can be easily removed by for example passing the material through an oven.

According to a further embodiment, after passing the material through the ironing die a thickness of the cup wall at least adjacent the cup base may be substantially the same as the base thickness of the sheet of metal material. The base thickness of the sheet of metal material may be for example less than 0.5 mm, more specifically less than 0.3 mm, for example 0.23 mm. As explained above, in draw/redraw processes the wall thickness of the cup tends to increase as the material passes through the successive dies such that a non-uniform thickness may result in the wall along its axial length. In particular the thickness tends to increase from the cup base towards the open end of the cup. As a result, after the draw/redraw process it is in particular the non-functional skirt section that may have a greater wall thickness than the functional section. This is particularly unnecessary and, with regard to material usage particularly undesired, as explained above. With the inventive subjecting of the redrawn cup to a wall ironing process the thickness of the non-functional skirt section can be reduced, for example to the base thickness of the sheet of metal material. The cup base also has a thickness substantially the same as the base thickness of the sheet of metal material. The functional section may have a wall thickness also substantially the same as the base thickness of the sheet of metal material, or for example more than the base thickness of the sheet of metal material. Thus, material usage can be reduced considerably.

According to a further embodiment, after passing the material through the ironing die a thickness of the cup wall adjacent the open end of the cup may be the same as or less than a thickness of the cup wall adjacent the cup base. In particular, the cup wall forming the non-functional section may be provided with a smaller thickness than the cup wall forming the functional section. In this way, material usage can be reduced even further.

According to a further embodiment, a score can be provided between the cup wall adjacent the cup base, in particular the functional section, and the cup wall adjacent the open end, in particular the non-functional section, the score defining a predetermined breaking line when opening a container, such as a bottle, provided with the closure cap. The score thus separates the functional section from the non-functional section. While the section below the score line is referred to as a non-functional section it is noted that to provide the so called tamper evidence at least a ring below the score may still serve a function. According to a further embodiment the cup wall adjacent the cup base may further be provided with a thread for engaging a thread of a container, such as a bottle. Such a thread is usually formed upon placing the cap on a bottle top wherein the cap is formed according to a thread provided on the bottle top. Before placing the cap on a bottle top the cap may be provided with a knurling profile.

According to a further embodiment, the cup wall adjacent the open end may further be provided with at least one stiffening bead, preferably extending over the entire circumference of the cup wall. Such a stiffening bead gives the non-functional section additional stability, should this be required. Such a bead can be formed in the subsequent knurling process which is required to form the cap above the score line including the same. Such a bead can be formed in the subsequent knurling process which is required to form the cap above the score line including the same.

The first or second redraw die may further comprise a nesting die having an annular recess adjacent a radius of the first or a second redraw die, and the first or a second redraw pad may comprise an annular surface cooperating with the annular recess defining a gap for passage of material to the radius of the first or second redraw die.

An embodiment of the disclosed method comprises providing second redraw tooling including a second redraw die, a second redraw pad, and a second redraw punch movable between an extended position cooperating with the second redraw die and a retracted position. A second redrawing of the redrawn cup is performed with the second redraw tooling after the first redrawing and before passing the material through the ironing die to form a second redrawn cup having a cup base, a cup wall, and an open end. The second redrawing includes engaging a portion of the redrawn cup base between the second redraw pad and the second redraw die, and moving the second redraw punch to the extended position to draw material of the redrawn cup through the second redraw die.

The method may further comprise: a first draw reduction from the planar sheet of metal material to the first cup may be performed within a range of not significantly more than 50%, preferably about 35% to 45%; a second draw reduction from the first cup to the redrawn cup may be performed within a range of about 20% to 30%; and a third draw reduction from the redrawn cup to the second redrawn cup may be performed within a range of about 15% to 25%.

According to a further embodiment, movement of the first and/or second redraw punch may include cooperating with the first and/or second redraw die to perform a pinch trim on material adjacent an open end of the redrawn cup or the second redrawn cup. Pinch trim can thus be performed in the first redraw, irrespective whether a second redraw follows or not, and/or in the second redraw. The redrawn cup or the second redrawn cup may also be formed without trimming material. A pressure applied by the first redraw pad on an outer portion of the first cup material may be reduced and, subsequent to the reduction in pressure, the outer portion of the first cup material may be passed into the first redraw die.

The first cup may be formed by moving a first cup punch to an extended position to draw a blank of the sheet of metal material through a first cup draw die and define a first cup wall without subsequent working of the material passing through the first cup draw die. The cup wall of the redrawn cup or the second redrawn cup may further be formed by the first redraw die and first redraw punch or with the second redraw die and second redraw punch without subsequent working of the material passing through the first redraw die and/or the second redraw die.

A thickness of the cup wall of the redrawn cup or the second redrawn cup may increase before the wall ironing step a portion of the redrawn cup wall from the cup base toward the open end of the redrawn cup or the second redrawn cup.

According to a further embodiment the steps of passing the material through the ironing die and performing a pinch trim on material adjacent, an open end of the redrawn cup or the second redrawn cup may be carried out in a joint processing station, separate from a processing station performing a first redrawing of the first cup to form a redrawn cup and/or from a processing station performing a second redrawing of the redrawn cup to form a second redrawn cup. According to this embodiment, processing stations for performing redrawing steps on the one hand, and for performing the ironing step and a pinch trim on the other hand, are separated. In particular, the steps of ironing and pinch trimming are carried out in a processing station separate from any process stations for drawing or redrawing steps. While combining a redrawing step with ironing and pinch trimming steps in one joint processing station reduces complexity and potentially costs of the inventive method, it has been shown in practice that this may lead to defects, such as material splinters forming in this joint processing station. It is assumed that this undesired effect is caused by material tension during transfer of the material between the redrawing and the pinch trimming step. This can securely be avoided by the above explained embodiment where the redrawing step is separated from the ironing and pinch trimming step.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

Figure 1:
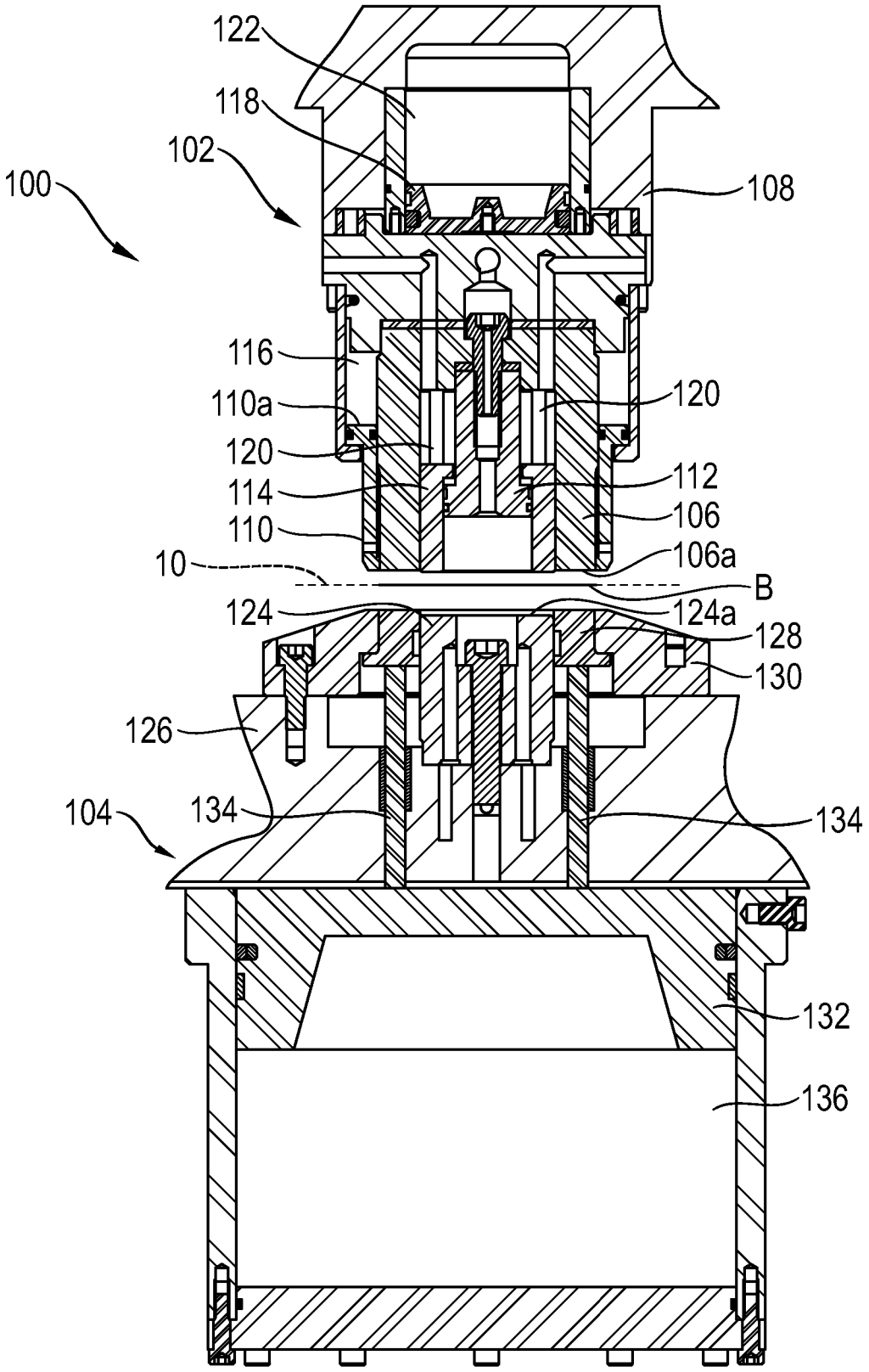
FIG. 1 schematically illustrates a sectional view of an embodiment of a first forming press including an upper assembly in a retracted position prior to formation of a first cup.

In the following detailed description of the preferred embodiment, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

The present application discloses methods and apparatus for forming panels, shells, or closure caps so that formed portions of the closure have controlled material working, minimizing metal working applied to the material of the closure cap at early stages of the forming process to substantially minimize earing or scuffing of outer edges of the formed caps, as well as to prevent or minimize formation of fluffs or hair-like formations produced from a coating or film applied to the sheet metal supplied for forming the closure caps.

Reference is now made to FIGS. 1-3 and 12(*a*)-(*c*), which illustrates a first forming press 100 having an upper assembly 102 and a lower assembly 104. In the illustrated embodiment, the upper assembly 102 comprises a movable assembly and the lower assembly 104 comprises a fixed assembly. However, the present invention is not limited to this particular configuration and the upper assembly 102 may be fixed and the lower assembly 104 may be movable. As illustrated herein, the upper assembly 102 is movable between an extended position where tooling carried by the upper assembly 102 cooperates with tooling of the lower assembly 104 to form a blank B comprising a planar sheet of material into a drawn, first cup C1, see FIGS. 1 and 12(*b*), and a retracted position where the upper assembly 102 is spaced from the lower assembly 104, see FIGS. 3, 12(*a*), and 12(*c*).

The upper assembly 102 includes a blank punch 106 supported in fixed relation to an upper die shoe 108. A stripper 110 surrounds the blank punch 106 and is supported in movable relation to the upper die shoe 108. A knockout retainer 112 is supported within the blank punch 106 in fixed relation to the upper die shoe 108, and a knockout 114 is supported between the knockout retainer 112 and the blank punch 106 for movement relative to the upper die shoe 108. The stripper 110 includes a stripper piston 110*a* located in a cylinder 116, e.g., an air cylinder, for biasing the stripper 110 toward the lower assembly 104. The knockout 114 is connected to a piston 118 via pressure pins 120. The piston 118 is located in a cylinder 122, e.g., an air cylinder, for biasing the knockout 114 toward the lower assembly 104.

The lower assembly 104 includes a draw die 124 supported in fixed relation to a lower die shoe 126, and is sized to extend into the blank punch 106 in a draw operation for forming the first cup C1. A draw pad 128 surrounds the draw die 124 and is supported in movable relation to the lower die shoe 126. A cut edge 130 surrounds the draw pad 128 and is supported in fixed relation to the lower die shoe 126. The draw pad 128 is connected to a lower piston 132 via pressure pins 134. The lower piston 132 is located in a cylinder 136, e.g., an air cylinder, for biasing the draw pad 128 toward the upper assembly 102.

Figure 2:
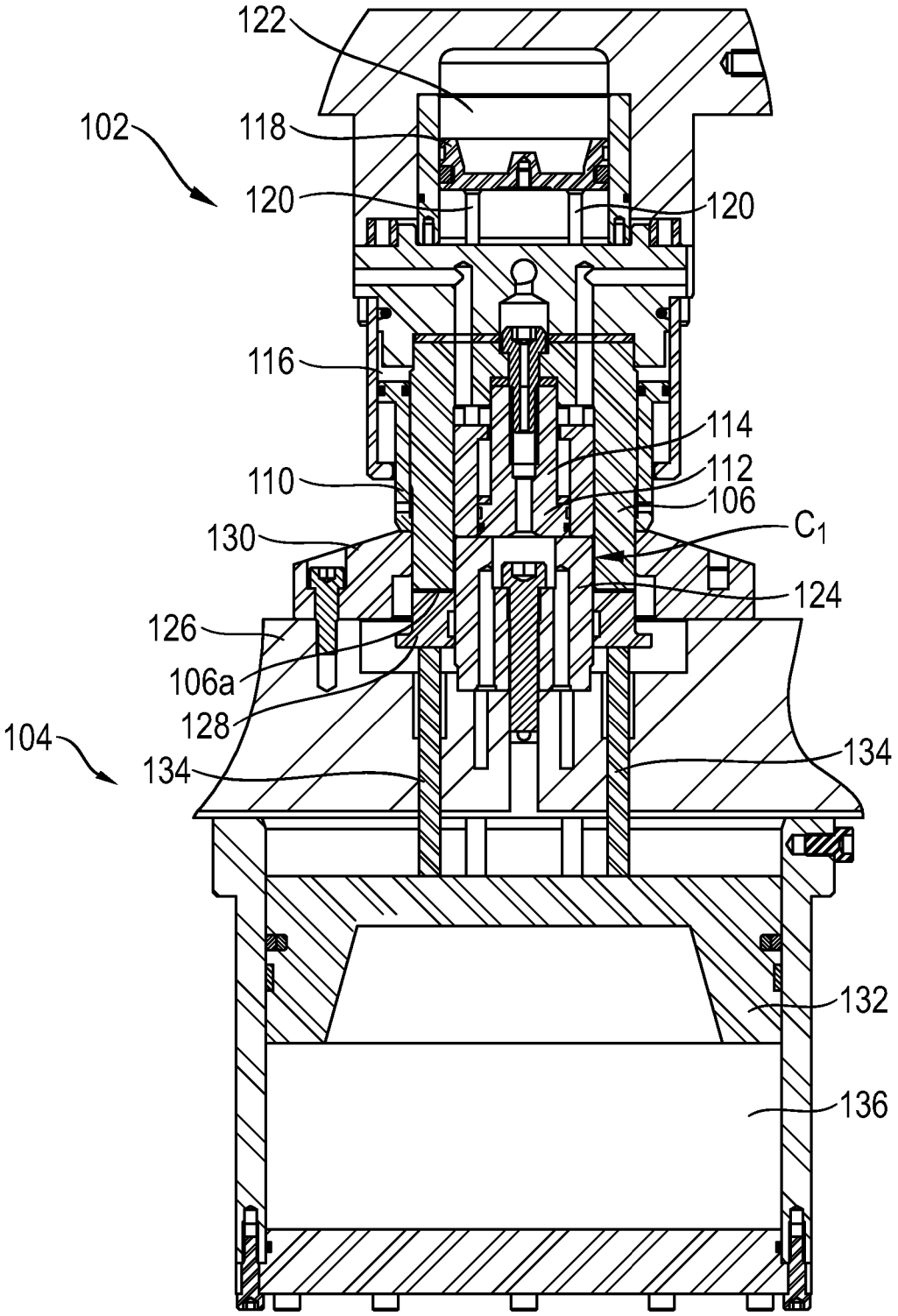
FIG. 2 schematically illustrates a sectional view of the embodiment of the first forming press of FIG. 1 with the upper assembly in an extended position forming the first cup.
Figure 2A:
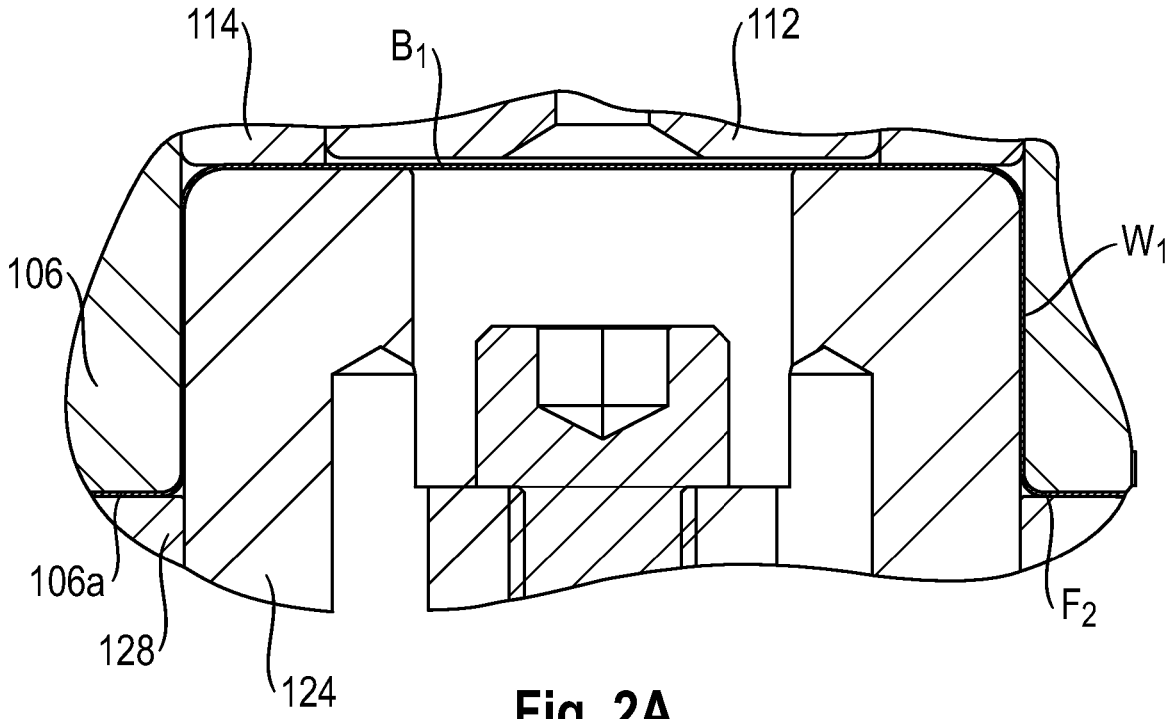
FIG. 2A schematically illustrates an enlarged sectional view of the formation of the first cup shown in FIG. 2.
Figure 3:
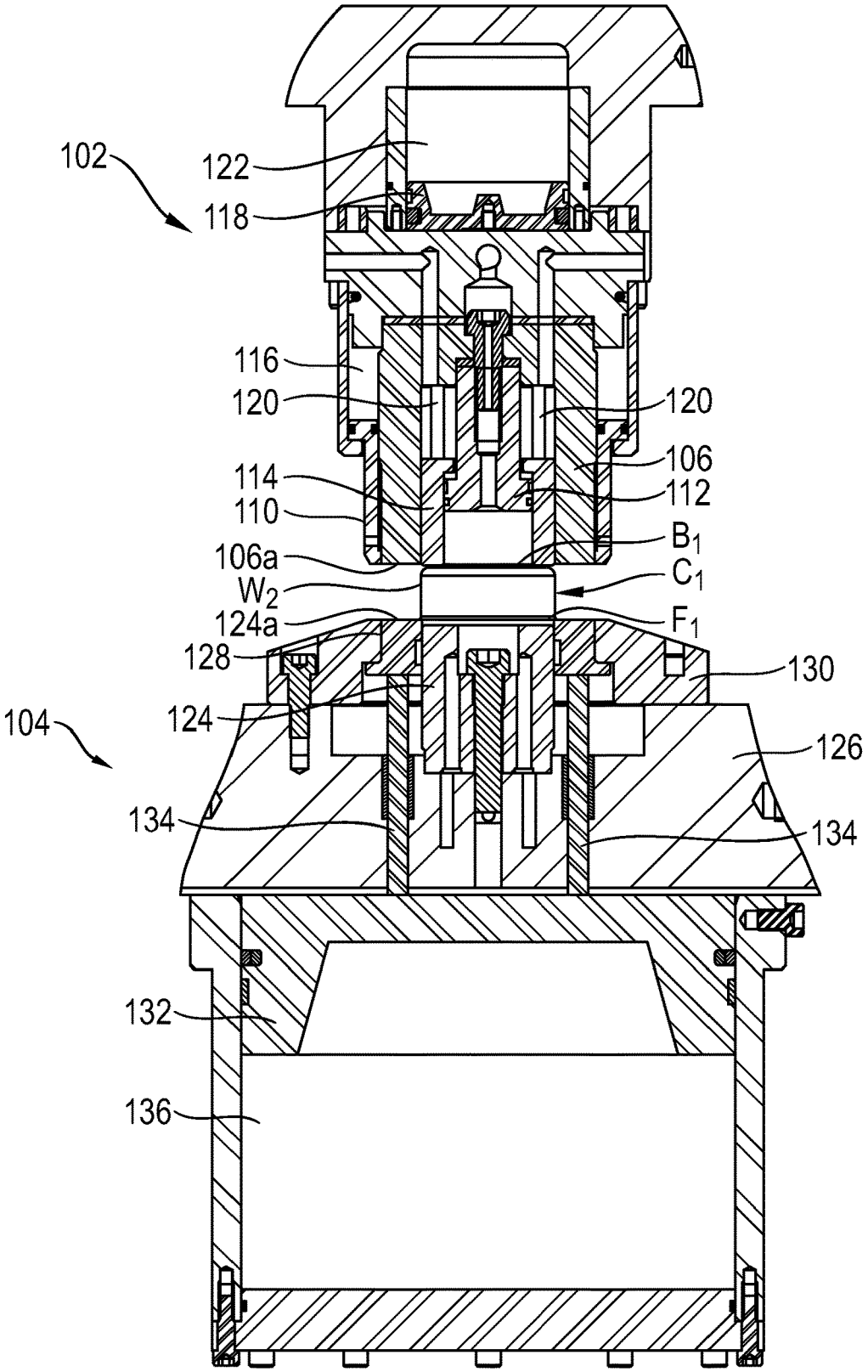
FIG. 3 schematically illustrates a sectional view showing the upper assembly of the forming press in the retracted position following formation of the first cup.

Operation of the first forming press 100 to form the first cup C1 comprises providing a planar sheet of material 10 comprising a metal, e.g., aluminum or steel sheet, as depicted by the dotted line extension of the blank B in FIG. 1. Referring to FIG. 2, as the upper assembly 102 moves downward toward the lower assembly 104, the stripper 110 is positioned adjacent to the cut edge 130 to clamp the sheet of material therebetween with a predetermined pressure applied from the stripper piston 110*a*. The sheet material 10 is additionally clamped between a lower blank punch surface 106*a* defined on the blank punch 106 and the draw pad 128. Continued downward movement of the upper assembly 102 causes a disk of the sheet of material 10 to be cut out to define the blank B, and the blank B is engaged between the knockout 114 and an upper surface draw die 124*a* of the draw die 124. As the upper assembly 102 moves further downward, relative movement between the blank punch 106 and the draw die 124 draws the material of the blank B radially inward and into the blank punch 106 to form the first cup C1. A radially outer portion of the blank B remains clamped between the lower blank punch surface 106*a* and the draw pad 128 at the end of the downward stroke of the upper assembly 102 to define a radial flange F1 at the open outer end of the first cup C1.

It may be understood that the drawing process performed by the first forming press 100 can result in the wall W1 of the drawn first cup C1 having a tapering thickness that increases from a base B1 of the first cup C1 toward an open, outer end of the cup C1 adjacent to the flange F1, wherein the base B1 has a thickness that is substantially the same as a base thickness of the sheet of material 10. The flange F1 does not pass into the blank punch 106 and comprises a radially or laterally extending outer portion of the cup C1 that defines a substantially unworked portion of the blank B extending radially from the wall W1.

Further, it may be understood that each of the draw and redraw operations or processes described herein can result in a thickening of the material as the material passes across or through a respective die to form a decreased cup diameter and greater wall height. A tapering, increasing wall thickness can be formed extending in a height direction from the base to the open, outer end of the cup in each draw/redraw operation described herein, wherein a greater volume of material is contained in the wall, per unit length in the height direction, adjacent to the open, outer end of each formed cup than the volume of material forming the wall adjacent to the base. In an exemplary draw/redraw operation described herein, each step in the draw/redraw operation can cause a nominal thickening of the formed cup wall, as measured adjacent to the open, outer end of the cup, of about 110%, e.g., from 108% to 112%, relative the nominal thickness of the material of the blank or previously thickened cup wall prior to passing though the die. However, it may be understood that the present description is not limited to the exemplary changes in thickness described herein.

Figure 4:
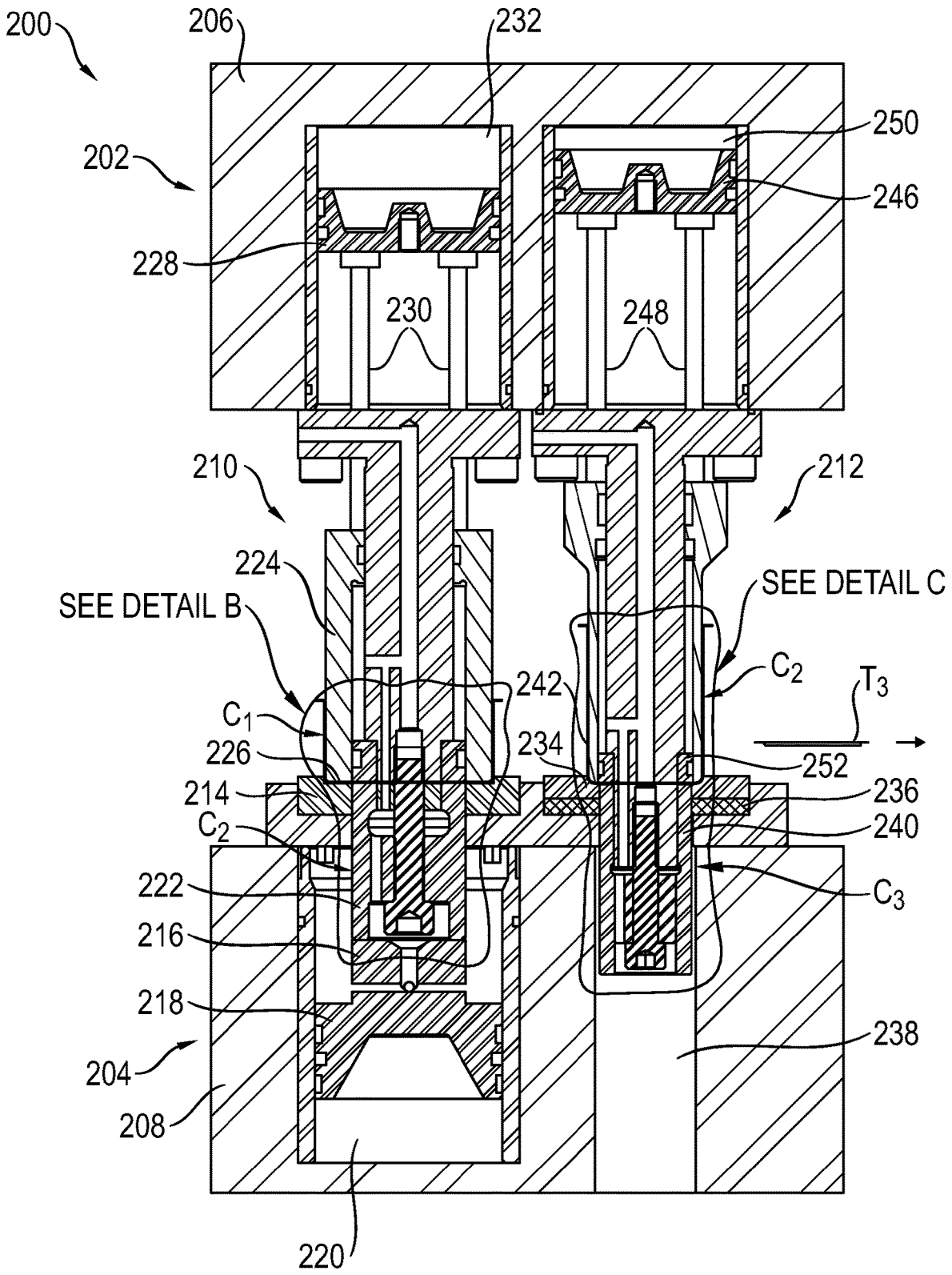
FIG. 4 schematically illustrates a sectional view showing an embodiment of a second forming press including an upper assembly in an extended position of first and second redraw tooling.
Figure 12:
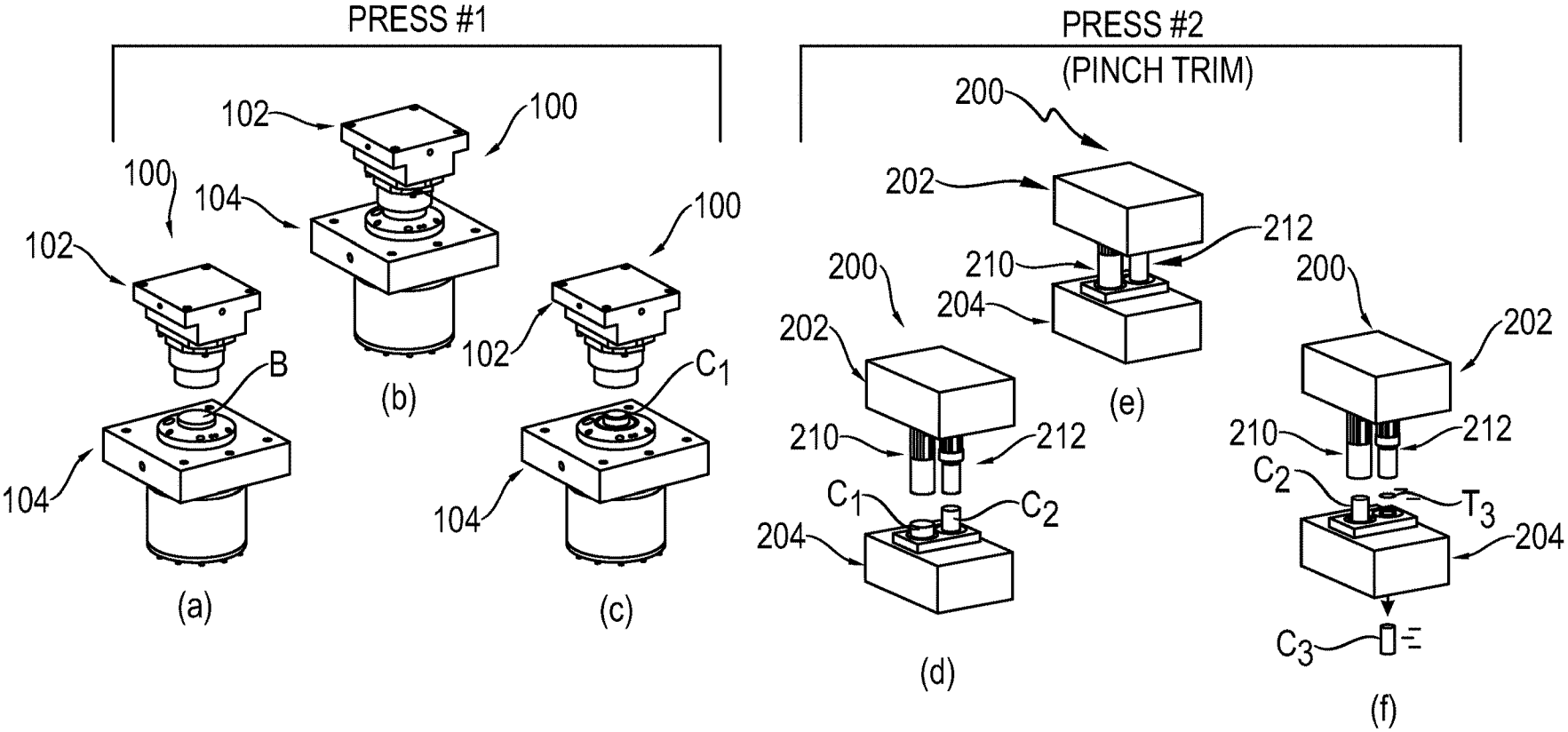
FIG. 12*a* illustrates a perspective view of a formation step performed by the first forming press.
FIG. 12*b* illustrates a perspective view of another formation step performed by the first forming press.
FIG. 12*c* illustrates a perspective view of another formation step performed by the first forming press.
FIG. 12*d* a perspective view of a formation step performed by the second forming press.
FIG. 12*e* illustrates a perspective view of another formation step performed by the first forming press.
FIG. 12*f* illustrates a perspective view of another formation step performed by the first forming press.

Referring to FIGS. 4 and 12(*d*)-12(*f*), a second forming press 200 is illustrated having an upper assembly 202 and a lower assembly 204, wherein the upper assembly 202 comprises a movable assembly and the lower assembly 204 comprises a fixed assembly. In the illustrated embodiment, the upper assembly 202 comprises an upper die shoe 206 and the lower assembly 204 comprises a lower die shoe 208, wherein the upper and lower die shoes 206, 208 carry first and second redraw tooling 210, 212 for performing first and second redraw operations. It may be understood that, although the first and second redraw tooling 210, 212 is described herein as being provided in the same press, i.e. the second forming press 200, and the upper assembly 202 is described as being movable and the lower assembly 204 is described as being fixed, the invention is not limited to this particular described configuration.

Figure 5:
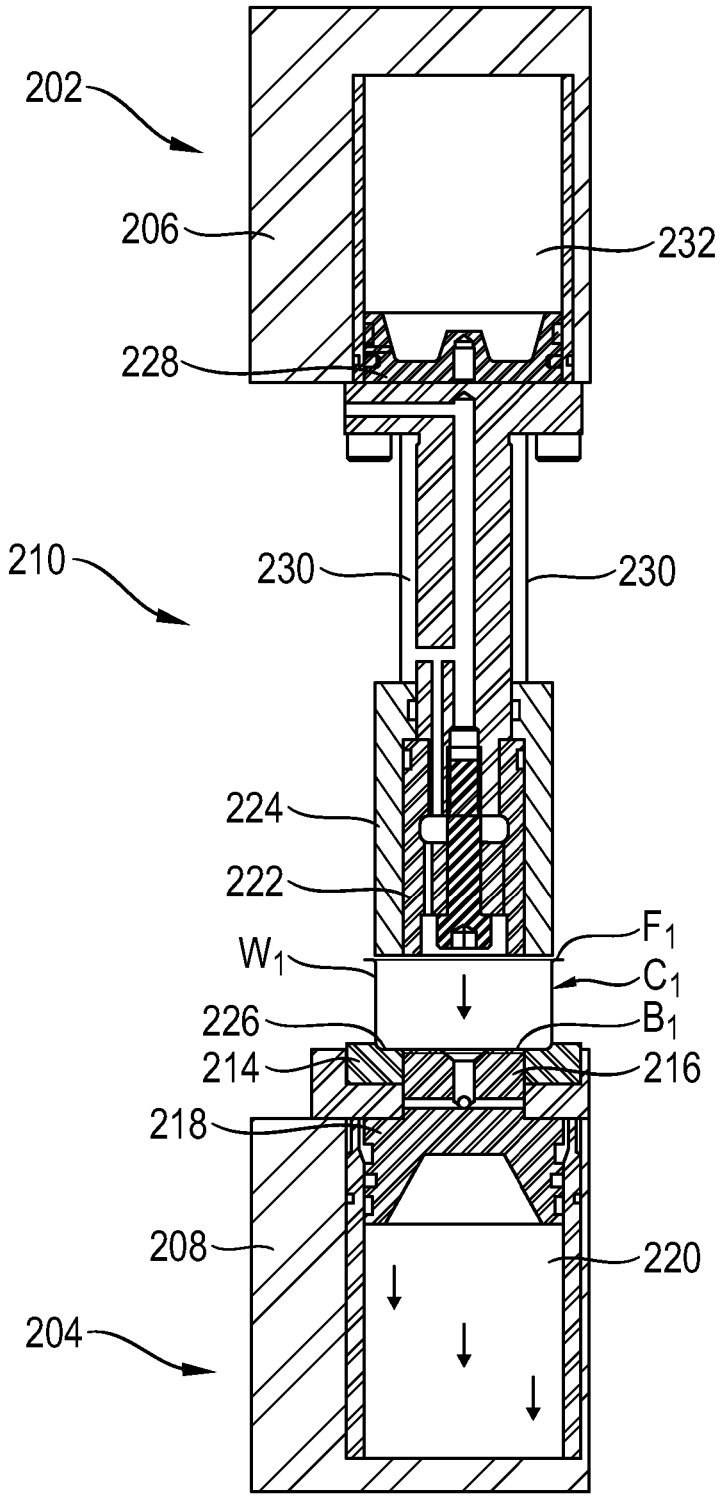
FIG. 5 schematically illustrates a sectional view showing the first redraw tooling in a retracted position prior to formation of the redrawn cup.

Referring further to FIG. 5, the first redraw tooling 210 includes a first redraw die 214 supported in fixed relation to the lower die shoe 208. A lower panel punch 216 is supported for movement relative to the lower die shoe 208 and is sized to extend upward through the first redraw die 214 and includes a lower piston 218 located within a lower cylinder 220, e.g., an air cylinder, for biasing the lower panel punch 216 upward toward the upper assembly 202.

A first redraw punch 222 is supported in fixed relation to the upper die shoe 206 and is sized to pass into the first redraw die 214, wherein the first redraw punch 222 is movable with the upper die shoe 206 between an extended position cooperating with the first redraw die 214, see FIGS. 4 and 12(*e*), and a retracted position, see FIGS. 5, 12(*a*) and 12(*c*), in a redraw operation for redrawing the first cup C1. A first redraw pad 224 surrounds the first redraw punch 222 and is sized to extend into the first cup C1 to engage the base B1 between the first redraw pad 224 and a first redraw die surface 226 defined on the first redraw die 214. The first redraw die surface 226 can comprise a recessed area generally corresponding to the circumference of the first cup C1.

The first redraw pad 224 is connected to an upper piston 228 via connecting members 230. The upper piston 228 is located in an upper cylinder 232, e.g., an air cylinder, for biasing the first redraw pad 224 toward the lower assembly 204. The first redraw pad 224 is biased to engage a portion of the first cup base B1 with a predetermined first force between the first redraw pad 224 and the redraw die 214, wherein the predetermined first force is determined by an air pressure provided to the upper cylinder 232.

Figure 4A:
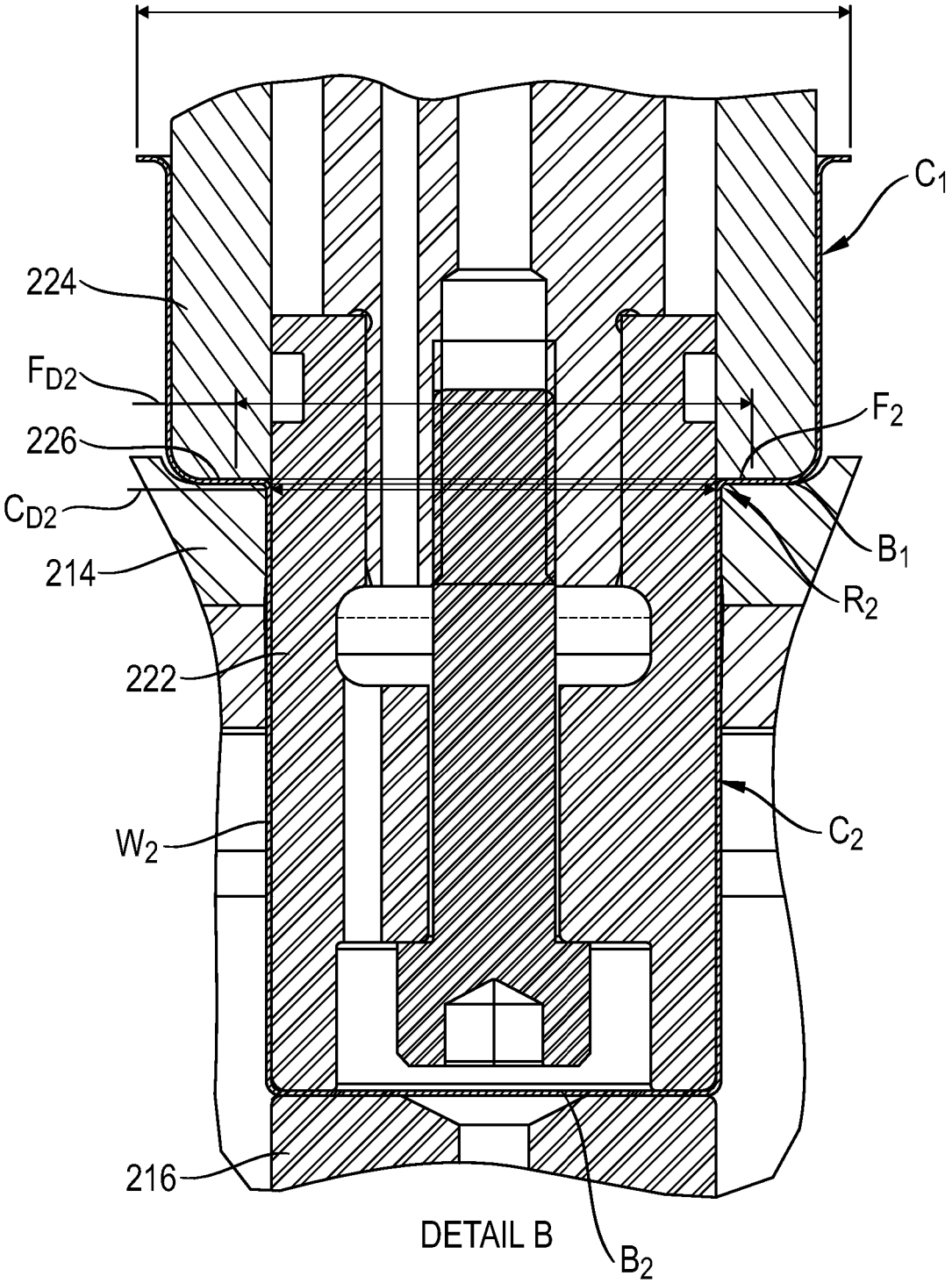
FIG. 4A schematically illustrates an enlarged sectional view of the formation of a first redraw cup in the first redraw tooling shown in FIG. 4.

Operation of the second press 200 to redraw the first cup C1 in the first redraw tooling 210 comprises placing the first cup C1, with its open end facing upward, in association with the first redraw die 214, as seen in FIG. 5. As depicted in FIGS. 4 and 4A, as the upper assembly 202 moves downward toward the lower assembly 204, the first redraw pad 224 is positioned adjacent the first redraw die surface 226, as defined on the first redraw die 214, to clamp the first cup base B1 therebetween with the predetermined first force applied from the upper piston 228. It may be noted that FIGS. 4 and 4A depict both the first cup C1, i.e., before being redrawn to a reduced diameter, and a redrawn cup C2 formed by passage through the first redraw die 214.

Continued downward movement of the upper assembly 202 causes the first redraw punch 222 to extend down through the first redraw die 214, drawing the material of the first cup $C_1$ over a radius R2 to define a redrawn cup diameter $CD_2$. As can be seen in FIG. 4, the upper piston 228 moves upward in the upper cylinder 232 and the lower piston 218 moves downward in the lower cylinder 220 as the upper and lower assemblies 202, 204 move together to provide the predetermined first force from the upper piston 228 and to provide a pressure from the lower piston 218 via the lower panel punch 216 against the lower side of the base $B_2$ as the redrawn cup $C_2$ is formed.

The first redraw operation is performed with the first redraw pad 224 cooperating with the first redraw die 214, i.e., at the interface with the first redraw die surface 226, to constrain the material of the first cup $C_1$ to bend across the radius of the first redraw die 214, resulting in the material forming a thicker wall $W_2$ for the redrawn cup $C_2$ than the wall thickness of the first cup $C_1$. As discussed above, in an exemplary embodiment, the material thickness of the cup wall can have a nominal increase of approximately 110% (range 108% to 112%) as the first cup C1 passes through the first redraw die 214. Hence, if the blank B has an exemplary thickness of approximately 0.23 mm, the wall W1 of the first cup C1 may have a nominal thickness of approximately 0.25 mm (range from 0.24 mm to 0.26 mm) as the material thickness increases a nominal amount of approximately 110%, and the wall W2 of the redrawn cup C2 adjacent at least the open, outer end of the redrawn cup C2, may have a nominal thickness of approximately 0.27 mm (range from 0.26 mm to 0.28 mm) as the wall thickness increases a nominal amount of approximately 110%.

During the redraw operation, at least a portion of the material of the first cup C1, adjacent to the first cup flange F1, is not constrained with the predetermined first force to bend across the radius of the first redraw die 214. For example, at the end of the downward stroke of the first redraw punch 222, a portion of the material of the first cup C1 may remain between the first redraw pad 224 and the first redraw die 214 to define a flange F2 of the redrawn cup C2, as is depicted by the flange diameter FD2 in FIG. 4A. It may be understood that the thickness of the wall W2 of the redrawn cup C2 is typically not uniform and can comprise an increasing thickness extending in an axial direction from the base B2 to the open, outer end of the redrawn cup C2. It should also be understood that in the draw/redraw operations described herein, the tapering wall thickness is generally only constrained by the clearance between the draw/redraw punch and the corresponding draw/redraw die. This clearance between the punch and die is typically 107% to 115% over the thickness increase in the individual draw/redraw stations.

Since the material forming the flange F2 of the redrawn cup C2 is not worked by passage of the material over the radius of the first redraw die 214, the flange F2 a comprises a radially or laterally extending outer portion of the redrawn cup C2 comprises substantially unworked material that defines a generally uniform radius extending from the wall W2. Further, since the outer portion of the redrawn cup C2, i.e., defining the flange F2, is not constrained to bend across the radius of the first redraw die 214, the coating or film applied to the material of the redrawn cup C2 is not subjected to forces that could cause the coating or film to separate from the base material, such that fine hair-like debris, hereinafter referred to as "fluffs," is substantially avoided in the redraw process. Such fluffs, if permitted to form, could accumulate in the tooling and interfere with the reforming process as multiple first cups C1 are redrawn in the first redraw die 214.

Figure 6:
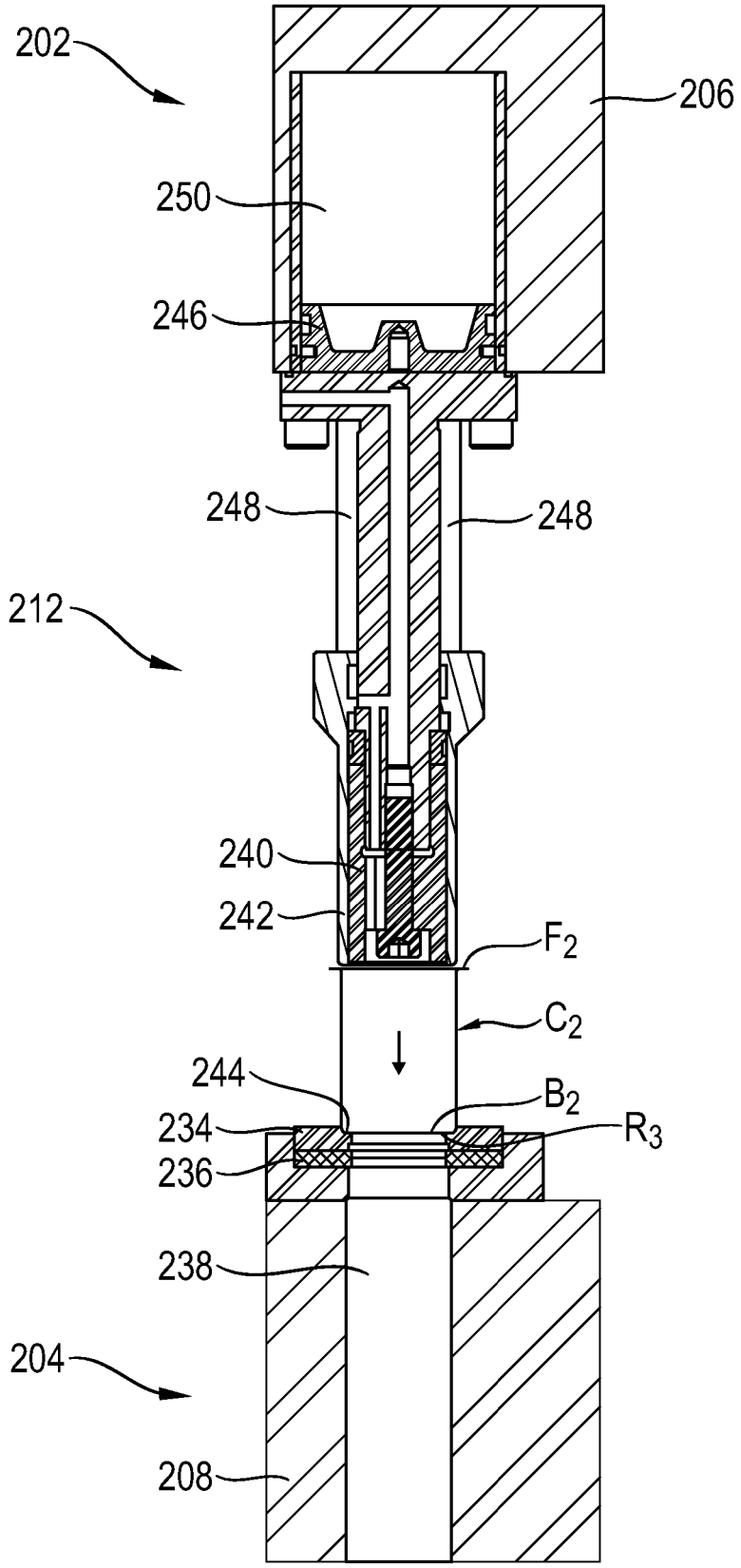
FIG. 6 schematically illustrates a sectional view showing the second redraw tooling in a retracted position prior to formation of the final cap.

Referring to FIGS. 4 and 6, the second redraw tooling 212 includes a second redraw die 234 supported in fixed relation to the lower die shoe 208. An ironing die 236 is supported in fixed relation to the lower die shoe 208 and is located below the second redraw die 234. A through passage 238 extends downward from the ironing die 236 and defines a diameter that is greater than an inner diameter defined by the ironing die 236.

A second redraw punch 240 is supported in fixed relation to the upper die shoe 206 and is sized to pass into the second redraw die 234, wherein the second redraw punch 240 is movable with the upper die shoe 206 between an extended position cooperating with the second redraw die 234, see FIGS. 4 and 12(*b*), and a retracted position, see FIGS. 6, 12(*a*), and 12(*c*), in a redraw operation for redrawing the redrawn cup $C_2$. A second redraw pad 242 surrounds the second redraw punch 240 and is sized to extend into the redrawn cup C2 to engage the base B2 between the second redraw pad 242 and a second redraw die surface 244 defining a nesting die on the second redraw die 234. The second redraw die surface 244 can comprise a recessed area generally corresponding to the circumference of the redrawn cup C2.

The second redraw pad 242 is connected to an upper piston 246 via connecting members 248. The upper piston 246 is located in an upper cylinder 250, e.g., an air cylinder, for biasing the second redraw pad 242 toward the lower assembly 204. The second redraw pad 242 is biased to engage a portion of the redrawn cup base B2 with a predetermined second force between the second redraw pad 242 and the second redraw die 234, wherein the predetermined second force is determined by an air pressure provided to the upper cylinder 250.

Figure 4B:
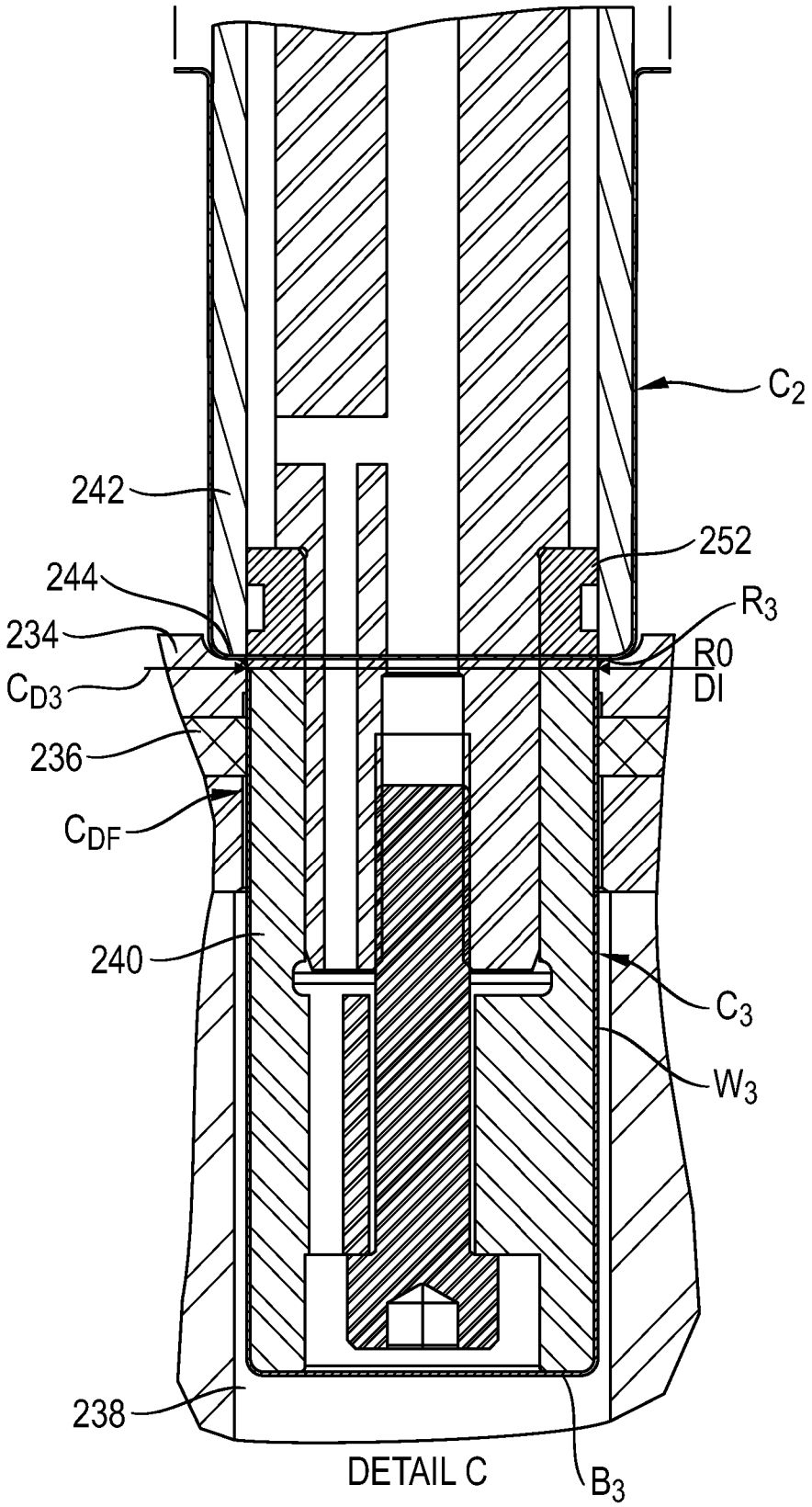
FIG. 4B schematically illustrates an enlarged sectional view of the formation of a final cap in the second redraw tooling shown in FIG. 4.

Operation of the second press 200 to redraw the redrawn cup C2 in the second redraw tooling 212 comprises placing the redrawn cup C2, with its open end facing upward, in association with the second redraw die 234, as seen in FIG. 6. As depicted in FIGS. 4 and 4B, as the upper assembly 202 moves downward toward the lower assembly 204, the second redraw pad 242 is positioned adjacent the second redraw die surface 244, as defined on the second redraw die 234, to clamp the redrawn cup base B2 therebetween with the predetermined second force applied from the upper piston 246. It may be noted that FIGS. 4 and 4B depict both the redrawn cup C2, i.e., before a second redraw operation to a reduced diameter, and a second redrawn cup or final cap C3 formed by passage through the second redraw die 234.

Continued downward movement of the upper assembly 202 causes the second redraw punch 240 to extend down through the second redraw die 234, drawing the material of the redrawn cup C2 over a radius R3 to define a second redrawn cup diameter CD3. Further, the second redraw punch 240 draws the material passing from the second redraw die 234 through the ironing die 236 to reduce the wall thickness of the final cap wall W3 and form a final diameter CDF for the final cap C3. As can be seen in FIG. 4, the upper piston 246 moves upward in the upper cylinder 250 as the upper and lower assemblies 202, 204 move together to provide the predetermined second force from the upper piston 246 as the final cap C3 is formed. The final cap C3 can pass out of the second redraw tooling 212 in the same direction as movement of the second redraw punch 240 to the extended position, e.g., downward as seen in FIG. 12(*c*).

The second redraw operation is performed with the second redraw pad 242 cooperating with the second redraw die 234 to constrain the material of the redrawn cup C2 to bend across the radius R3 of the second redraw die 234, resulting in the material passing the second redraw die 234 forming an initial wall thickness that is greater than the wall thickness of the redrawn cup C2. As discussed above, in an exemplary embodiment, the material thickness of the cup wall can have a nominal increase of approximately 110% (range 108% to 112%) as the redrawn cup C2 passes through the second redraw die 234. Hence, if the redrawn cup $C_2$ has an exemplary nominal wall thickness of approximately 0.27 mm, the wall thickness of the material passing the second redraw die 234 may be approximately 0.29 mm (range 0.28 mm to 0.30 mm) as the material thickness increases a nominal amount of approximately 110%, wherein the nominal thickness of the material near the open, outer end following the second redraw may be approximately 34% over the starting base thickness. Subsequently, as the material passes through the ironing die 236, the wall thickness is reduced to form for example a generally uniform wall thickness. In the exemplary embodiment described herein, the generally uniform wall thickness formed by ironing may be approximately 0.23 mm for the final cap $C_3$, i.e., the final thickness of the final cap wall $W_3$ can be approximately equal to the base thickness defined by the planar blank B of the sheet of material 10, and equal to the thickness of the base $B_3$. Hence, the ironing step may reduce the material thickness near the open, outer end by approximately 34%. In a further exemplary embodiment, the uniform thickness of the final cap wall $W_3$ can be slightly less than the base thickness defined by the planar blank B of the sheet of material 10. It is also possible that after passing through the ironing die the wall thickness of the final cap $C_3$ is lower in a section adjacent the open end than in a section adjacent the cup base $B_3$. For example the wall section with the higher thickness may be separated from the wall section with the lower thickness by a score, as explained below.

During the second redraw operation, at least a portion of the material of the redrawn cup $C_2$, at or adjacent to the redrawn cup flange F2, does not pass through the second redraw die 234 and is cut off. In particular, the second redraw punch 240 carries a pinch trim ring 252 having a diameter that is greater than the diameter of the second redraw punch 240. As the second redraw punch 240 approaches the end of its downstroke, the material of the redrawn cup C2 is pinched between an edge of the pinch trim ring 252 and the radius R3 of the second redraw die 234, separating a thin annular trim portion T3 from an outer end of the final cap C3. Hence, a portion of the redrawn cup C2, e.g., a portion that can includes at least a portion of the flange F2, is trimmed from the open end of the final cap C3 at the conclusion of the second redraw operation, and formation of fluffs is substantially avoided in the redraw process, wherein the trim portion T3 can be removed from the second redraw tooling 212 as the upper assembly 202 is retracted at the conclusion of the second redraw operation.

It may be understood that the first cup C1 and redrawn cup C2 each include a side wall having a maximum thickness that is greater than a base thickness defined by the planar blank B of the sheet of material 10. In particular, during the drawing and first redrawing operations, the work applied to the material forming the wall portion of the first cup C1 and redrawn cup C2 is minimized by permitting a thickening of the wall in each of these operations, i.e., a tapering thickening in the axial direction from the base (adjacent to the punch radius) toward the open end (adjacent to the cup flange) of the first cup C1 and redrawn cup C2. Subsequently, thinning of the material to a final thickness, for example substantially equal to or slightly less than the base thickness is performed in the second redraw operation, i.e., the last redraw operation, by an ironing die 236 to perform the only ironing operation in the steps for forming the final cap C3. That is, the final cap C3 can have a uniform or substantially uniform wall thickness, extending axially from the base B3, wherein the wall thickness can be the same thickness as the base B3, i.e., equal to the base thickness. The described series of draw/redraw steps, with minimum working of the side wall material, are selected and arranged to minimize any earing or scuffing that might occur at the open end of the final cap $C_3$. Hence, a thin walled deep drawn cap $C_3$ can be provided with a substantial reduction or minimization of waste material, such as has been associated with earing and scuffing produced by prior known processes.

Figure 7:
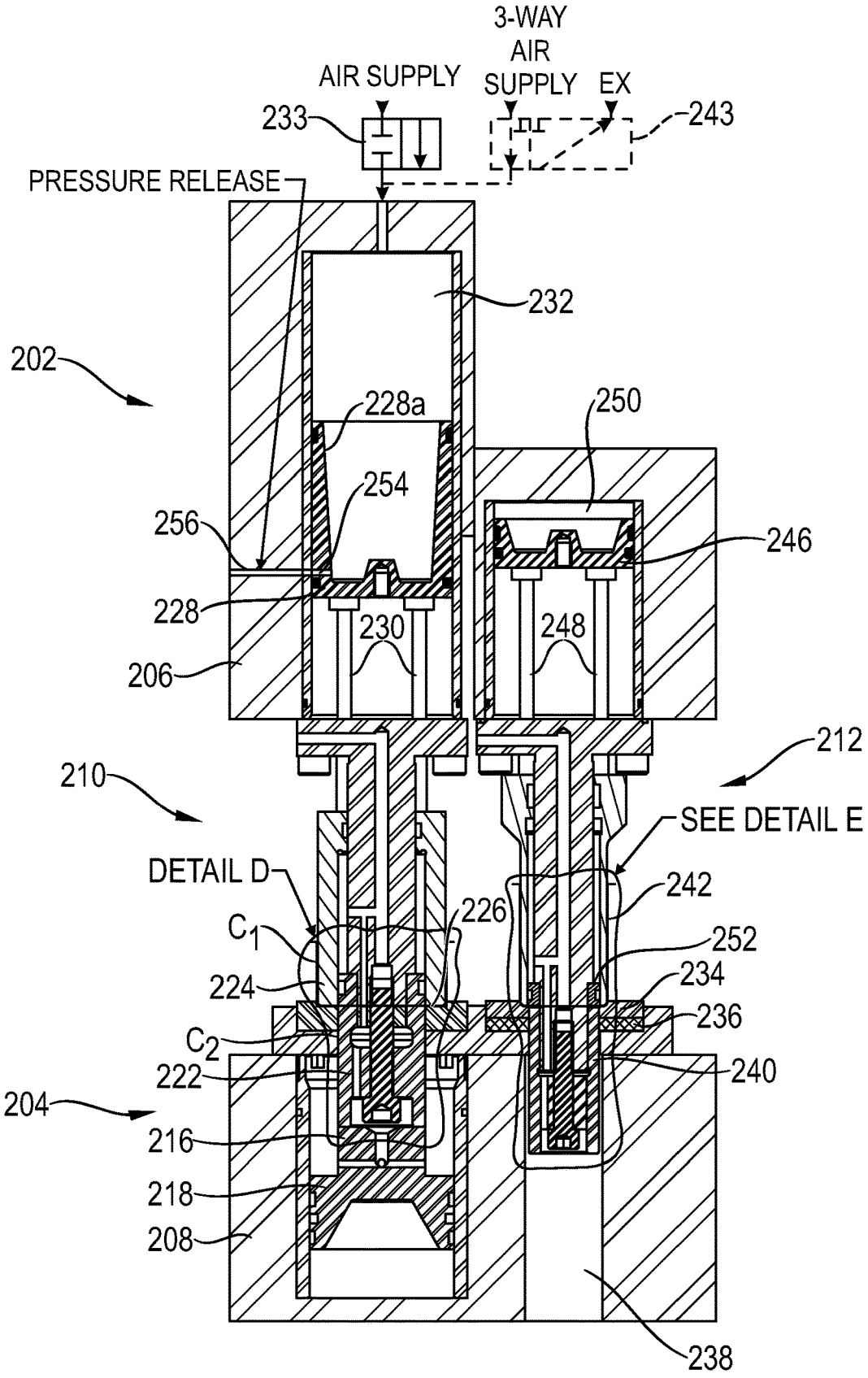
FIG. 7 schematically illustrates a sectional view showing an alternative embodiment of the second forming press including an upper assembly of the second forming press in an extended position of first and second redraw tooling.
Figure 7A:
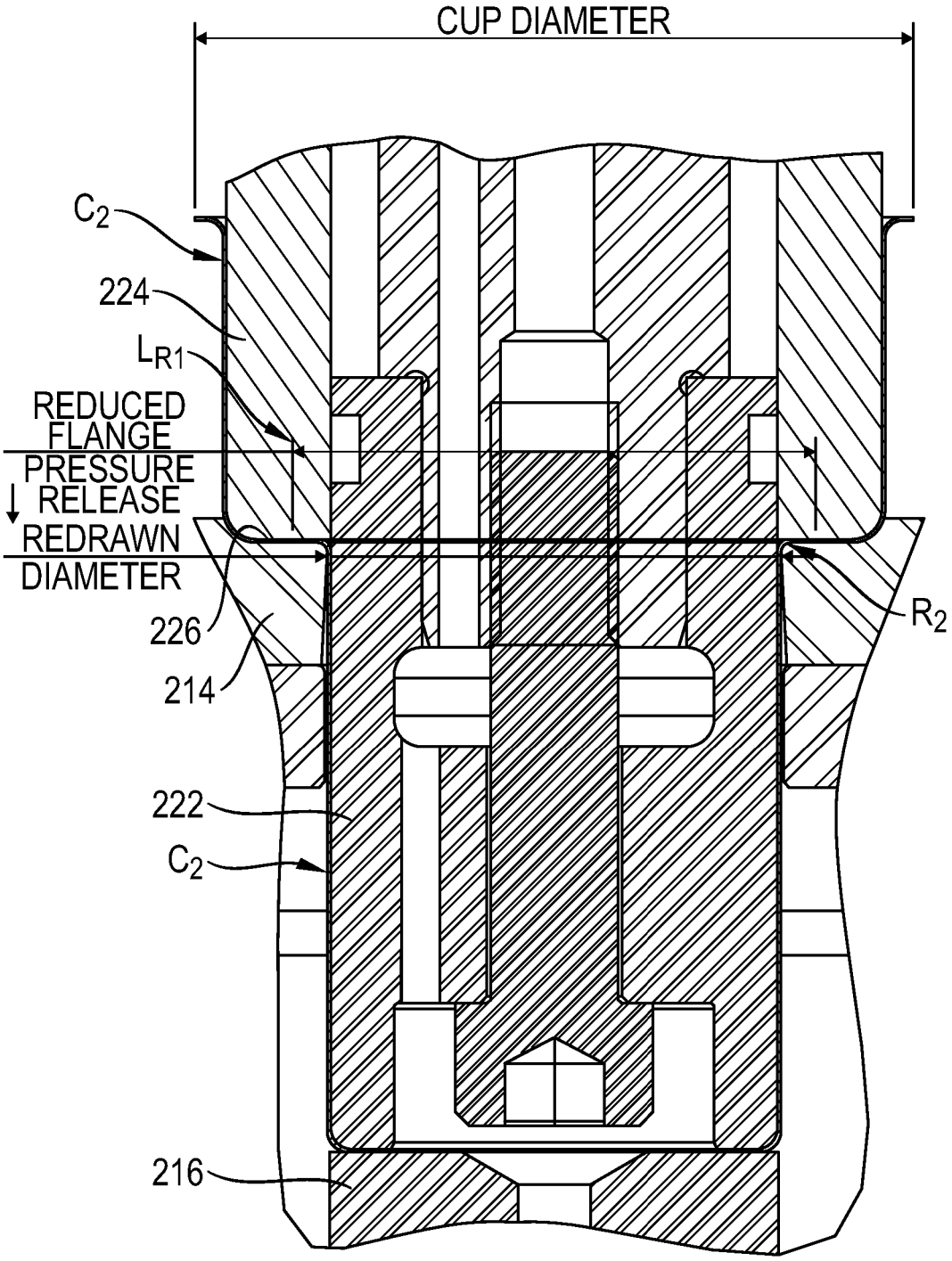
FIG. 7A schematically illustrates a sectional view showing an enlarged view of the formation of a redrawn cup in the first redraw tooling shown in FIG. 7.
Figure 8:
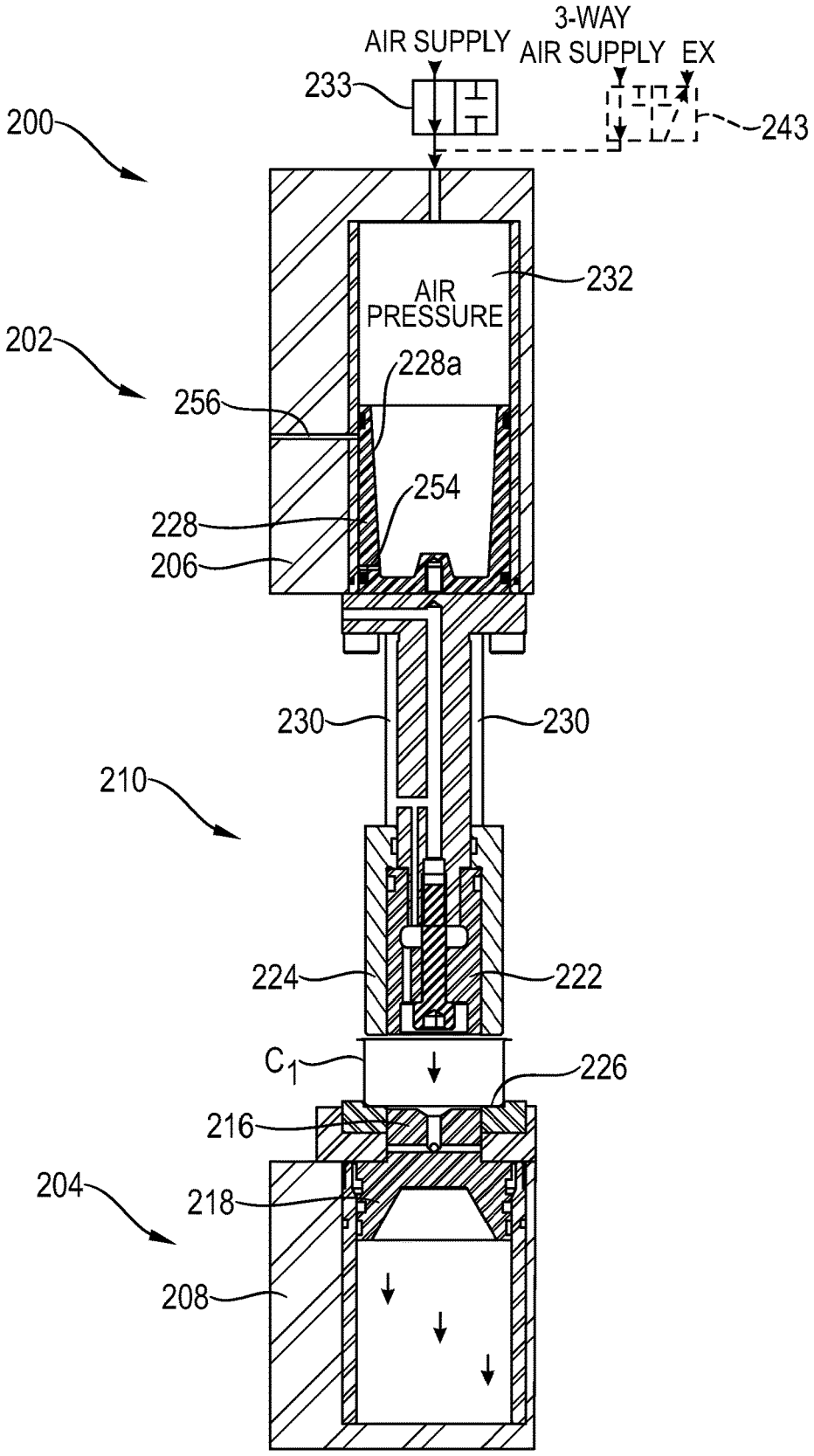
FIG. 8 schematically illustrates a sectional view showing the redraw tooling of FIG. 7 in a retracted position prior to formation of the flangeless redrawn cup.

Referring to FIGS. 7, 7A, and 8, an alternative configuration of the second forming press 200 is described, wherein formation of the redrawn cup $C_2$ is modified in the first redraw operation. The second forming press 200 of the alternative configuration has essentially the same elements as the configuration illustrated in FIGS. 4-6 with the exception that the first redraw tooling 210 has structure for reducing the clamping force applied by the first redraw pad 224 at the end of the first redraw operation.

Referring to FIGS. 7 and 8, the upper cylinder 232 is provided with air at a predetermined air pressure supplied from an air supply via a two-way valve 233 to apply a predetermined first force to the first redraw pad 224. Further, the upper piston 228 for applying a predetermined first force to the first redraw pad 224 is provided with a radial vent passage 254 that can be positioned in vertical alignment with a corresponding exhaust passage 256 formed through the upper die shoe 206 for venting air from the upper cylinder 232 at a predetermined position in the downward stroke of the upper assembly 202. It can additionally be seen that the upper piston 228 in FIGS. 7 and 8 is formed with an extended upper portion 228*a* that can cover the exhaust passage 256 during vertical movement of the upper piston 228 where the vent passage 254 is located below the exhaust passage 256. For example, as seen in FIG. 8, at the beginning of the first redraw operation of the present embodiment, and throughout the majority of the redraw operation, the upper portion 228*a* of the upper piston 228 covers the exhaust passage 256 and permits a predetermined pressure to be maintained in the upper cylinder 232.

It may be understood that the present description is not limited to the particular configuration described herein for providing control over the air pressure in the upper cylinder 232. For example, as is depicted in dotted lines in FIGS. 7 and 8 (cf. also FIG. 13), a three-way valve 243 may be provided instead of the two-way valve 233 to supply and exhaust air to and from the upper cylinder 232 via the three-way valve 243, wherein the vent passage 254 and exhaust passage 256 would not be required.

Figure 9:
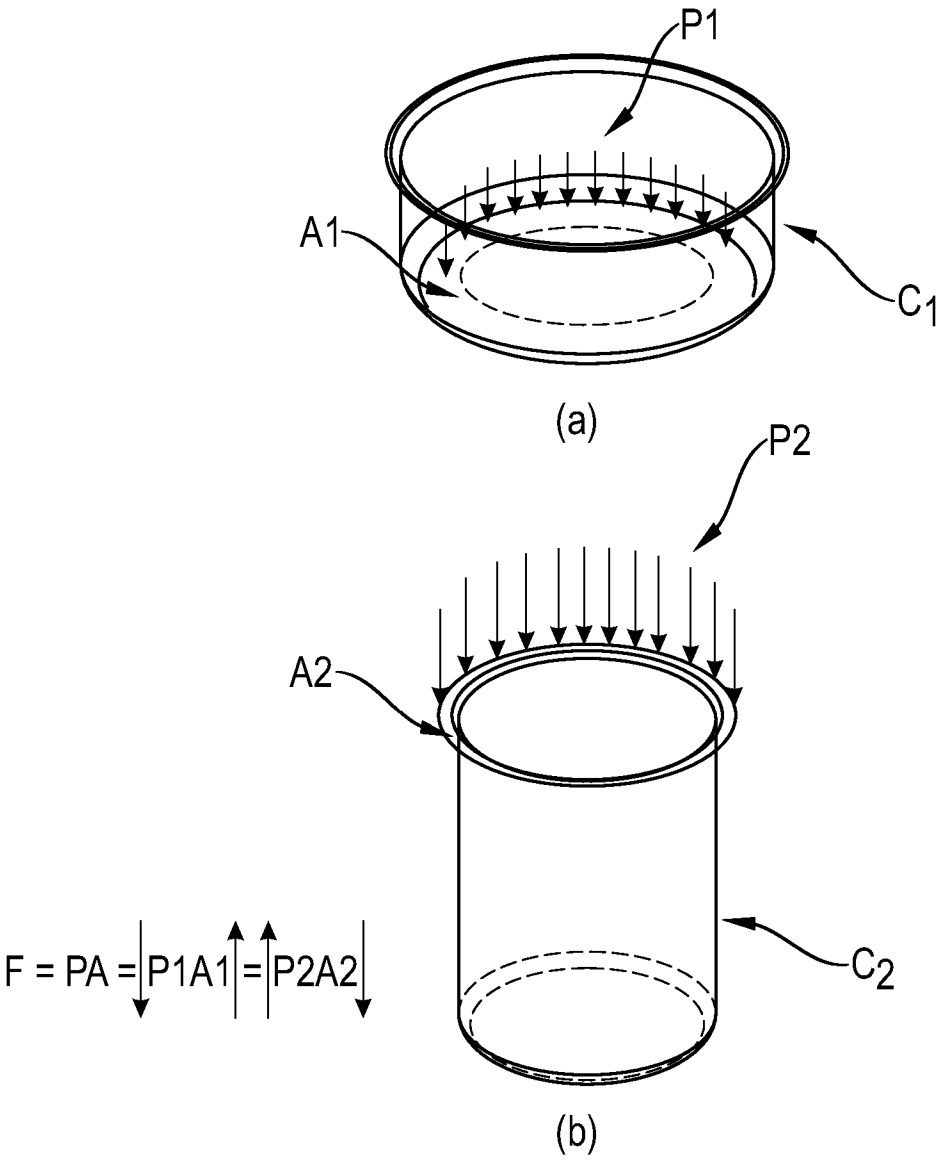
FIG. 9*a* schematically illustrates a variation of pressure forces applied by redraw clamps to material passing to a redraw die.
FIG. 9*b* schematically illustrates further variations of pressure forces applied by redraw clamps to material passing to a redraw die.

In an alternative first redraw operation, the redrawn cup C2 can be formed without a flange. Specifically, the downward stroke of the first redraw punch 222 is extended to draw all of the material of the first cup C1 through the first redraw die 214. As the final portion of first cup C1 is drawn toward the first redraw die 214 and, in particular, as a portion of the first cup flange F1 is clamped between the first redraw pad 224 and the first redraw die 214, the pressure on the clamped material increases as the annular clamped area of the material under the first redraw pad 224 decreases. In particular, with a constant force, i.e., the predetermined first force, applied from the upper piston 228 to the first redraw pad 224 and a decreasing material area supporting the clamp force, the pressure applied to the material increases. This is illustrated in FIG. 9, wherein FIG. 9(*a*) illustrates an area A1 that defines the annular material area engaged by the first redraw pad 224 throughout the majority of the first redraw operation, such that a pressure P1 is applied to the material equal to the predetermined first force F divided by the area engaged by the first redraw pad 224. FIG. 9(*b*) illustrates a final portion of the material remaining during formation of the redrawn cup C2 in the first redraw operation, wherein the annular area A2 is less than the annular area A1 such that the pressure P2 applied by the first redraw pad 224, equal to the predetermined first force F divided by the area A2 of the remaining material, is greater than the pressure P1, and the pressure P2 continues to increase until all of the material has passed into the first redraw die 214. The increased pressure can cause the formation of fluffs as the edge of material passes into the first redraw die 214. Further, the increased pressure, if maintained during the entire first redraw process, can result in increased strain and distortion of the material forming the open, outer end of the redrawn cup $C_2$ in the form of earing or scuffing.

In accordance with an aspect of the alternative embodiment, the pressure in the upper cylinder 232 is released or reduced at a predetermined point in the downward stroke of the first redraw punch 222. As seen in FIG. 7, the vent passage 254 in the upper piston 228 is aligned with the exhaust passage 256 leading from the upper cylinder 232 when upper assembly 202 is close to the end of its downward stroke, but prior to the first redraw punch 222 fully drawing the first cup C1 through the first redraw die 214, such as when an increased clamping pressure at the gap between the first redraw punch 222 and the first redraw die 214 is beginning, as is illustrated by pressure P2 in FIG. 9(*b*). FIG. 7A illustrates the location LR1 of the outer edge of the reduced flange of the first cup C1 when the force applied by the first redraw pad 224 is reduced via the reduction of pressure in the upper cylinder 232. As the first redraw punch 222 continues to move downward, positioning the vent passage 254 out of alignment with the exhaust passage 256, the remaining pressure in the upper cylinder 232 is maintained in order to maintain a reduced force to the first redraw pad 224 during the remainder of the first redraw process to avoid formation of creases or wrinkles in the material as the remainder of the material is drawn through the first redraw die 214. Hence, the resulting redrawn cup C2 can have a substantially uniform outer edge at the open end, i.e., without earing or scuffing, and can be transferred to the second redraw operation without trimming of the outer (non-flanged) edge.

Referring again to FIG. 7, the second redraw tooling 212 for the alternative embodiment is the same as the tooling for the first described embodiment, as described with reference to FIGS. 4, 4B, and 6. In particular, the second redraw operation is performed with the second redraw pad 242 cooperating with the second redraw die 234 to constrain the material of the redrawn cup C2 to bend across the radius R3 of the second redraw die 234, resulting in the material passing through the second redraw die 234 forming an initial wall thickness that is greater than the wall thickness of the redrawn cup C2. Subsequently, as the material passes through the ironing die 236, the wall thickness is reduced to a final wall thickness that can for example be approximately equal to the base thickness defined by the planar blank B of the sheet of material 10, and equal to the base B3. Further, the final thickness of the final cap wall W3 can be slightly less than the base thickness defined by the planar blank B of the sheet of material 10. Also the wall thickness can be less in a section adjacent the open end compared to a section adjacent the base B3. Additionally, the pinch trim ring 252 can pinch trim an outer edge portion of the material, i.e., a thin annular trim portion T3 from an outer end of the final cap C3. Hence, a portion of the redrawn cup C2 is trimmed from the open end of the final cap C3 at the conclusion of the second redraw operation.

Figure 10:
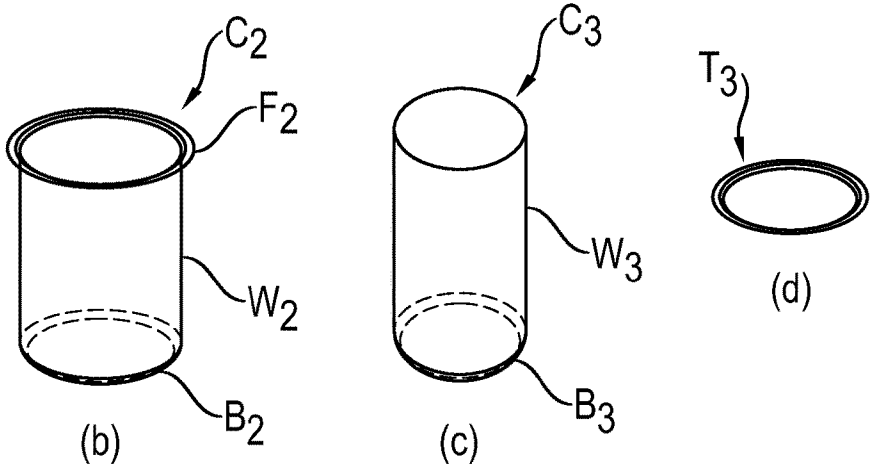
FIG. 10*a* illustrates a perspective view of an embodiment of a progression of material formation of a first drawn cup.
FIG. 10*b* illustrates a perspective view of an embodiment of the progression of material formation of a first flanged redrawn cup.
FIG. 10*c* illustrates a perspective view of an embodiment of the progression of material formation of a second redrawn cup following a pinch trim removal of the flange and defining a final cap ironing step.
FIG. 10*d* illustrates a perspective view of an embodiment of the progression of material formation of a trim piece comprising a flange that is pinch trim from the second redrawn cup.

Referring to FIGS. 10(*a*)-10(*d*), a first embodiment of the draw/redraw process, as described herein to form a thin-walled deep drawn final cap C3, initially forms the first cup C1 having a tapered wall thickness that increases in the axial upward direction, wherein the thickness of the wall W1, near at least the outer, open end of the first cup $C_1$, is greater than the base thickness, and the flange $F_1$ of the first cup $C_1$ comprises substantially unworked material, see FIG. 10(*a*). The first cup $C_1$ is redrawn to form a redrawn cup $C_2$ having an increased wall height and a decreased diameter, wherein the thickness of the wall $W_2$, near at least the outer, open end of the redrawn cup $C_2$, is greater than the wall thickness $W_1$ near the outer, open end of the first cup $C_1$, as discussed above. Further, the flange $F_2$ of the redrawn cup $C_2$ comprises substantially unworked material, see FIG. 10(*b*). In the second redraw operation, the redrawn cup $C_2$ is redrawn to form a redrawn final cap $C_3$ having an increased wall height and a decreased diameter, wherein the wall thickness is initially increased with passage of the material through the second redraw die 234, and then the wall $W_3$ of the final cap $C_3$ is formed as a reduced, final thickness as the material passes the ironing die 236, see FIG. 10(*c*), as discussed above. Further, an outer flange of material that does not pass through the second redraw die 234 is pinch trimmed and removed as an annular trim portion $T_3$, see FIG. 10(*d*). As may be understood from the description above, each draw/ redraw operation can result in a thickness increase of the material being drawn that is nominally equal to (base thickness)×(1.1×1.1×1.1), resulting in a thickness increase of 33% to 34%. More generally, the nominal thickness increase may fall within a range from [(base thickness)×(1.08×1.08×1.08)] to [(base thickness)×(1.12×1.12×1.12)] or 25% to 40%. In the exemplary embodiment described above, ironing is not performed during formation of cups C1 and C2, and the material defined by the flanges F1, F2, near the open, outer end of the drawn and redrawn cups C1, C2, remains substantially unworked until formation of the final wall thickness of the final cap C3, such that earing or scuffing associated with working of the outer edge areas of the material is avoided, with an associated reduction or elimination of waste material that could otherwise be produced in trimming of the eared or cuffed material. However, it may be understood that ironing may also be provided in one or both of the draw and first redraw operations.

Figure 11:
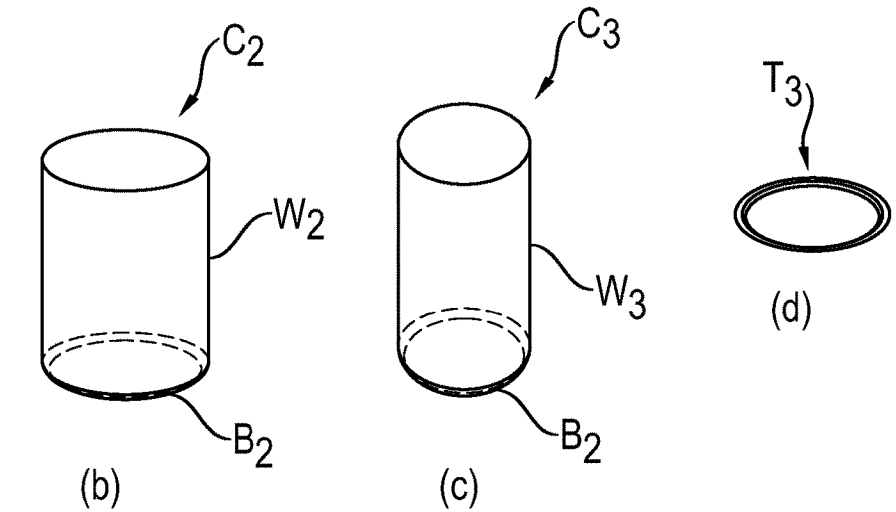
FIG. 11*a* illustrates perspective view of a second embodiment of the progression of material formation of a first drawn cup.
FIG. 11*b* illustrates perspective view of a second embodiment of the progression of material formation of the first flangeless redrawn cup.
FIG. 11*c* illustrates perspective view of a second embodiment of the progression of material formation of the second redrawn cup following a pinch trim removal of the flange and defining a final cap ironing step.
FIG. 11*d* illustrates perspective view of a second embodiment of the progression of material formation of the trim piece comprising a flange that is pinch trim from the second redrawn cup.

Referring to FIGS. 11(*a*)-11(*d*), an alternative embodiment of the draw/redraw process, as described herein to form a deep drawn final cap C3, initially forms the first cup C1 having a tapered wall thickness that increases in the axial upward direction, wherein the thickness of the wall W1, near at least the outer, open end of the first cup C1, is greater than the base thickness, and the flange F1 of the first cup C1 comprises substantially unworked material, see FIG. 11(*a*). The first cup C1 is redrawn to form a redrawn cup C2 having an increased wall height and a decreased diameter, wherein the thickness of the wall W2, near at least the outer, open end of the redrawn cup C2, is greater than the wall thickness W1 near the outer, open end of the first cup C1, as discussed above. Further, as a result of the pressure applied by the first redraw pad 224 being released or reduced near the end of the first redraw operation, strain to the material of the outer end of the redrawn cup C2 is minimized with reduced work to the open, outer end of the redrawn cup C2, see FIG. 11(*b*). In the second redraw operation, the redrawn cup C2 is redrawn to form a second redrawn or final cap C3 having an increased wall height and a decreased diameter, wherein the wall thickness is initially increased following the second redraw die 234, and then the wall W3 of the final cap C3 is formed as a reduced, uniform final thickness as the material passes the ironing die 236, see FIG. 11(*c*). Further, an outer flange of material that does not pass through the second redraw die 234 is pinch trimmed and removed as an annular trim portion T3, see FIG. 11(*d*). In the second redraw, the ironing die 236 reduces the wall thickness by at least approximately the percentage that the material thickens through the draw/redraw processes, e.g. if the nominal percentage increase in wall thickness through all of the draw/redraw stages is 34%, then the ironing die 236 may provide a nominal decrease in wall thickness of 34%. It may be understood that the material defined by the flange F1, near the open, outer end of the first cup C1, is substantially unworked, and the material near the open, outer end of the redrawn cup C2 remains minimally worked until formation of the final thickness of the final cap C3, such that earing or scuffing associated with working of the outer edge areas of the material is avoided, with an associated reduction or elimination of waste material that could otherwise be produced in trimming of the eared or cuffed material.

The above described draw/redraw processes can be used to form successively smaller diameter cups with greater wall height such as to form, e.g., a 30 mm×60 mm (diameter/wall height) final cap $C_3$. For example, the initial draw step, or first operation draw reduction, can be defined as [(blank diameter)−(initial cup diameter)]/(blank diameter), wherein the first draw reduction may be in the range of 35% to 45%, and for example no more than 50%. The first redraw step, or second operation first redraw reduction, can be defined as [(initial cup diameter)−(first redrawn cup diameter)]/(initial cup diameter), wherein the second draw reduction may be in the range of 20% to 30%. The second redraw step, or third operation second/final redraw reduction, can be defined as [(first redrawn cup diameter)−(second redrawn cup diameter)]/(second redrawn cup diameter), wherein the third draw reduction may be in the range of 15% to 25%. It should be understood that the above-described reductions are exemplary and not limiting, and that further, or intermediate, redraw steps could be added prior to the final redraw reduction such as to form a further reduced diameter and deeper redrawn cup.

With regard to the ironing process performed by the ironing die 236 following the final redraw reduction, the ironing is performed to reduce the thickness of the redrawn material forming the final cap wall W3, transitioning unused material volume to additional wall length. That is, the tapered, increasing thickness of the wall material, that is approximately equal to 134% of the base thickness in the exemplary embodiment described herein, can be reduced to a generally uniform thickness of approximately 100% of the base thickness along the length of the final cap wall W3, with a concurrent increase in the length of the wall to define a final predetermined wall length.

Further, while development of the present process for draw/redraw of material to form a pilfer proof cap recognizes that the area adjacent to the open end of the cap is generally non-functional and dimensionally less critical (in the thickness direction) than the wall adjacent the closed end of the cap with respect to the pilfer proof aspect of the cap, an aspect of the present process has utilized the additional volume of material accumulated in this dimensionally less critical area of the cap wall to extend the wall length, permitting use of less starting material, i.e., a smaller diameter blank, with an associated substantial economic benefit in the high volume production of pilfer proof caps. It may be understood that the present process can provide the described benefit, to redistribute underutilized material in the skirt, and improve the economies of producing the caps without altering the dimensional characteristics of generally more critical portions of the cap, wherein the base end and portions of the cap wall adjacent to the base, such as may be provided for formation of a threaded portion and a scored frangible strip, can be maintained at the same thickness as is currently used in the industry.

Also, from the standpoint of the amount of work applied to the material, the reduced diameter starting blank produces a shallower first cup in the initial draw step. Hence, from the initial cup formation, less work and strain is applied to the material, which can contribute to less earing of the material in subsequent draw/redraw operations. Provision of a traditional lacquer coated blank, i.e., a non-laminate coated blank, can further contribute to a reduction in strain applied to the material as it is drawn and redrawn, as the coating can contribute to passage of the material through the tooling, e.g., by providing a lubricating surface. In particular, the coating can remain in place through the final material reduction as it passes through the ironing die 236. In this regard, it may be noted that the ironing applied by the ironing die 236 is a non-aggressive working of the material, e.g., reducing the thickness from approximately 134% to approximately 100% of base thickness, such that the coating remains intact, i.e., undamaged, to facilitate passage of material through the ironing die 236 with limited earing.

More generally, the pre-ironed wall thickness adjacent to the open, outer end of the cap may be 125% to 140% of the base thickness that can be reduced to approximately 100% of the base thickness or less (at least in the section near the open end), wherein the described ironing is relatively non-aggressive, essentially comprising a resizing of the material thickness, such that a reduction to approximately the base thickness can be performed without damaging a traditional lacquer coating on the metal material.

As used herein, "non-aggressive" working or ironing of the metal material, as applied by a wall ironing process for the current process, refers to ironing of the metal material that is approximately 57% or less than a material thickness reduction performed in traditional draw and wall ironing (DWI) applications, and can encompass a reduction in maximum material thickness within a range of approximately 25% to 40% to approximately the base thickness. Further, as used herein, "damage" to the lacquer coating refers to displacement of the lacquer coating resulting in complete or partial exposure of the metal material underlying the lacquer coating, or excessive thinning of the lacquer coating, such as may occur, without limitation, as a result of excessive pressure, abrasion and/or shearing force, or a combination thereof.

Although in the above exemplary embodiments a process is described with more than one redraw step, it should be understood that the invention also pertains to a process with only one redraw step. Although in the above exemplary embodiments the ironing step is described as being provided only at the end of the second or final redraw step, it should be understood that some ironing may also be provided in the draw and first redraw steps, in which case a reduced amount of final ironing would be required to obtain the final wall thickness following the final redraw step. In this regard, it may be understood that if a further ironing step is performed prior to the final redraw, such further ironing would essentially comprise a resizing that would not damage a traditional lacquer coating on the metal material.

Figure 13:
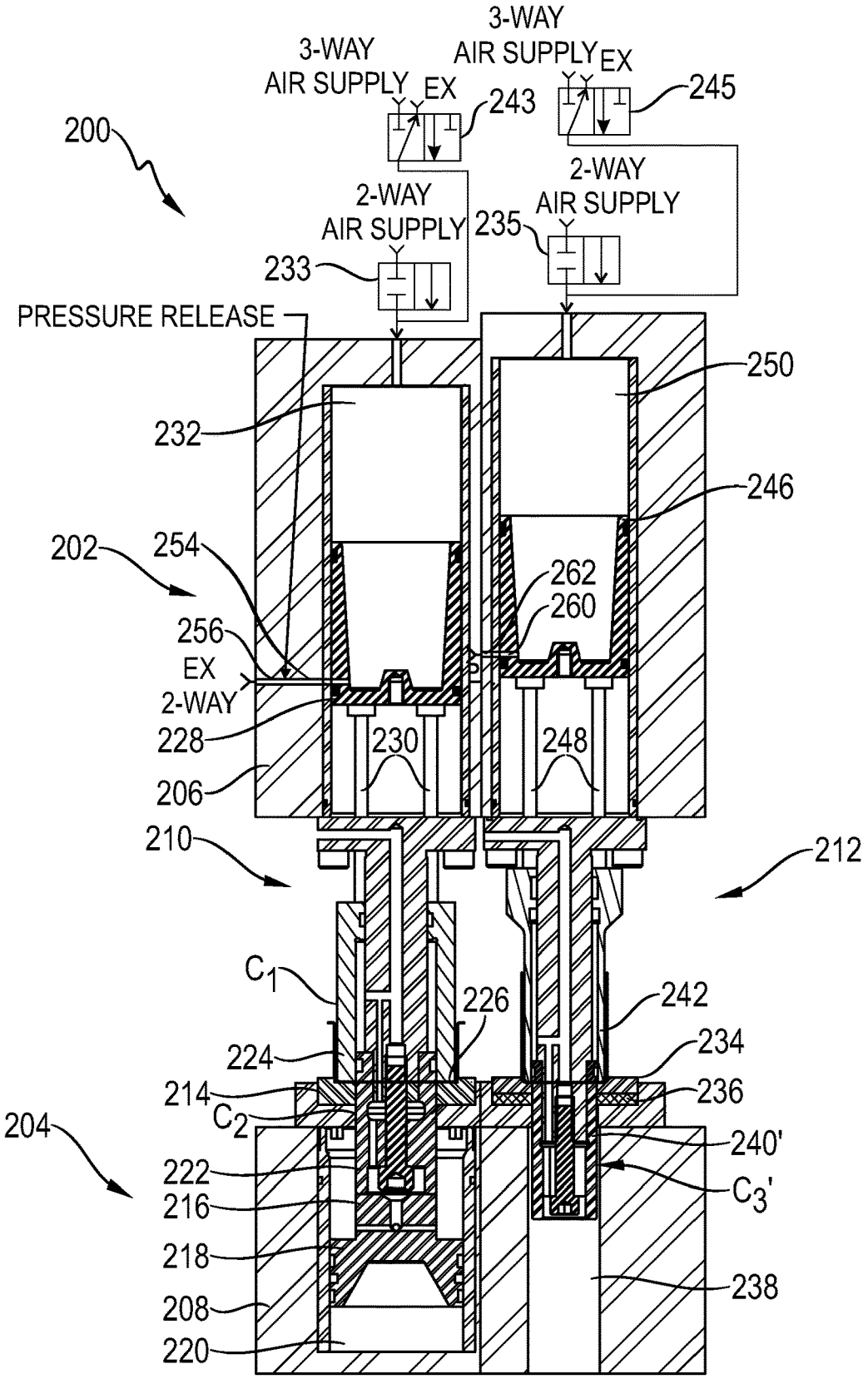
FIG. 13 schematically illustrates a sectional view of an alternative embodiment of the second forming press including an upper assembly of the second forming press in an extended position of first and second redraw tooling.

Referring to FIG. 13, a further alternative embodiment of the second redraw process is described, and comprises a modified second redraw punch 240' performing the second redraw operation without a pinch trim operation. The modified second redraw punch 240' includes an enlarged diameter portion that is configured to form a further configuration for a final cap C3' comprising a thinned wall portion of the final cap wall near the open, outer end of the wall of the final cap C3'. Although the thinned wall portion may have a relatively short length it should be understood that in some embodiments the thinned wall portion can extend from the open, outer end of the cap approximately two-thirds the total length of the final cap wall, or generally the length of a skirt portion for a pilfer proof cap. More generally, and without limitation, the thinned wall portion can extend from the open, outer end of the cap approximately one-third to three-quarters the total length of the final cap wall.

Referring again to FIG. 13, the upper cylinder 250 is provided with air at a predetermined air pressure supplied from an air supply via a two-way valve 235 to apply a predetermined second force to the second redraw pad 242. Further, the upper piston 246 for applying the predetermined second force to the second redraw pad 242 can be provided with a radial vent passage 260 that can be positioned in vertical alignment with a corresponding exhaust passage 262 formed through the upper die shoe 206 for venting air from the upper cylinder 250 at a predetermined position in the downward stroke of the upper assembly 202. Further, the modified second redraw punch 240' is constructed without a pinch trim ring, e.g., without the pinch trim ring 252, such that the modified second redraw punch 240' can draw all of the material of the redrawn cup C2 through the second redraw die 234 without a pinch trim operation. It can additionally be seen that the upper piston 246 in FIG. 13 is formed with an extended upper portion 246*a* that can cover the exhaust passage 262 during vertical movement of the upper piston 246 where the vent passage 260 is located below the exhaust passage 262. For example, at the beginning of the second redraw operation of the present embodiment, and throughout the majority of the second redraw operation, the upper portion 246*a* of the upper piston 246 covers the exhaust passage 262 and permits a predetermined pressure to be maintained in the upper cylinder 250, in a manner similar to that described and illustrated for the upper portion 228*a* of the upper piston 228 described with reference to FIG. 8.

It may be understood that the present description is not limited to the particular configuration described herein for providing control over the air pressure in the upper cylinder 250. For example, as is depicted exemplarily in FIG. 13, a three-way valve 245 may be provided instead of the two-way valve 235 to supply and exhaust air to and from the upper cylinder 250 via the three-way valve 245, wherein the vent passage 260 and exhaust passage 262 would not be required.

In an alternative second redraw operation, the final cap C3' can be formed without a flange and finished without a trim operation. Specifically, the downward stroke of the modified second redraw punch 240' is extended to draw all of the material of the redrawn cup C2 through the second redraw die 234. As the final portion of redrawn cup C2 is drawn toward the second redraw die 234 and, in particular, as the outer portion of the redrawn cup C2 is clamped between the second redraw pad 242 and the second redraw die 234, the pressure on the clamped material increases as the annular clamped area of the material decreases. In particular, with a constant force, i.e., the predetermined second force, applied from the upper piston 246 to the second redraw pad 242 and a decreasing material area supporting the clamp force, the pressure applied to the material increases, as is described above with reference to the alternative first redraw process.

In accordance with an aspect of the alternative embodiment, the pressure in the upper cylinder 250 is released or reduced at a predetermined point in the downward stroke of the second redraw punch 240'. As seen in FIG. 13, the vent passage 260 in the upper piston 246 is aligned with the exhaust passage 262 leading from the upper cylinder 250 when upper assembly 202 is close to the end of its downward stroke, but prior to the modified second redraw punch 240' fully drawing the redrawn cup C2 through the second redraw die 234, such as when an increased clamping pressure at the gap between the modified second redraw punch 240' and the second redraw die 234 is beginning, in a manner similar to that illustrated by pressure P2 in FIG. 9(*b*).

The thinned wall portion Wa3' of the final cap C3' can be formed by the enlarged diameter portion 240*a*' at the end of the downward stroke of the upper assembly 202. The thinned wall portion Wa3' may be provided to a relatively non-critical area of the final cap $C_3'$ to reduce the amount of material required to form the cap $C_3'$. For example, the area of the cap $C_3'$ between the thinned wall portion $Wa_3'$ and the cap base $B_3'$ may comprise a relatively thicker area that can be formed into a thread on a threaded end of a bottle, and the thinned wall portion $Wa_3'$ may define a remaining relatively thin sleeve between the threaded portion and the open, outer end of the final cap $C_3$. As a result of the minimal or reduced working of the material of the first and redrawn cups $C_1$, $C_2$, the material at the open, outer end of the final cap $C_3'$ can be formed substantially without earing or scuffing that could potentially result from, for example, ironing the wall thickness in the draw and first redraw steps of the forming process.

It should be noted that the formation of the final cap $C_3'$ without pinch trim could be implemented as a step following any of the above-described embodiments of the first redraw, wherein either a flanged or a flangeless redrawn cup $C_2$ could be redrawn in the second redraw tooling 212 described with reference to FIG. 13. Also, the second redraw with pressure release could be implemented as an alternative embodiment with pinch trim in any of the embodiments described herein.

Although the draw/redraw process is described above with reference to first and second presses with respective tooling, it should be understood that an alternative arrangement of presses and/or tooling may be utilized to obtain the cap forming aspects described herein. For example, a draw/reverse draw process may be utilized in the formation of the first cap wherein the first redraw is performed as a continuation of the cap forming, performed in a reverse direction, and a subsequent final redraw may be performed to complete the final cap. Alternatively, the final cap can be formed in the reverse draw with the reverse draw tooling including an ironing die to complete the final cap. In another configuration, telescopic tooling may be utilized to perform, for example, continuous successive draw and multiple redraw operations in as may be provided by telescoping punches having successively smaller diameters. Alternatively, the process described herein may be reconfigured to form wider and shallower cap, implementing a single redraw on a drawn cap, such as might be implemented by the above-described draw/reverse draw process including ironing, while providing the advantages described herein to utilize less material.

Also, while the description of the process set forth herein has been provided with particular reference to formation of pilfer proof caps, it should be understood that other caps, cups or shells for alternative uses may be formed and provided with the advantages described herein to utilize less material.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

The invention claimed is:

1. A method for forming a deep draw closure cap structured to be positioned over an upper end of a bottle, the method comprising:

draw forming a first cup from a planar sheet of a metal material defining a base thickness, wherein the first cup comprises a first cup base, a first cup wall, and an open end;

performing a first redrawing of the first cup to form a first redrawn cup comprising a first redrawn cup base, a first redrawn cup wall, and an open end;

passing the first redrawn cup through an ironing die to reduce a thickness of the first redrawn cup wall adjacent to the open end to be less than a thickness of the first redrawn cup wall adjacent to the first cup base;

providing second redraw tooling including a second redraw die, a second redraw pad, and a second redraw punch movable between an extended position cooperating with the second redraw die and a retracted position; and performing a second redrawing of the first redrawn cup with the second redraw tooling, wherein the second redrawing occurs after the first redrawing and before passing the first redrawn cup through the ironing die to form a second redrawn cup having a cup base, a cup wall, and an open end, the second redrawing comprising, engaging a portion of the redrawn cup base between the second redraw pad and the second redraw die, and moving the second redraw punch to the extended position to draw material of the redrawn cup through the second redraw die, wherein the performing the first redrawing is done using first redraw tooling, wherein the first redraw tooling comprises a first redraw die, a first redraw pad, and a first redraw punch movable between an extended position cooperating with the first redraw die and a retracted position, wherein a portion of the first cup base is engaged between the first redraw pad and the first redraw die, wherein a predetermined first force acts on the first cup base, wherein the first redraw pad cooperates with the first redraw die for constraining the metal material of the first cup to bend across a radius of the first redraw die, and wherein the first redraw punch is moved to the extended position to draw the metal material of the first cup through the first redraw die and define the redrawn cup wall, and wherein movement of at least one of the first redraw punch and the second redraw punch comprises cooperation with at least one of the first and second redraw die to perform a pinch trim on the metal material adjacent to an open end of at least one of: (1) the redrawn cup; and (2) the second redrawn cup.

2. The method according to claim 1, wherein the metal material is aluminum.

3. The method according to claim 1, wherein the draw forming and the first redrawing are performed in a reverse-draw method.

4. The method according to claim 1, wherein the metal material includes a coating that is applied prior to draw forming the first cup.

5. The method according to claim 4, wherein the coating is a lacquer coating.

6. The method according to claim 1, wherein a maximum thickness of the metal material passing through the ironing die is reduced by less than 70%.

7. The method according to claim 1, wherein a maximum thickness of the metal material passing through the ironing die is reduced by approximately 25%-40%.

8. The method according to claim 1, wherein a thickness of the cup wall at least adjacent the cup base is substantially the same as the base thickness of the planar sheet of metal material after passing the redrawn cup through the ironing die.

9. The method according to claim 1, wherein a thickness of the first redrawn cup wall adjacent to the open end of the first cup is at least one of: (1) a same thickness; and (2) less than a thickness of the first redrawn cup wall adjacent to the first redrawn cup base after passing the redrawn cup through the ironing die.

10. The method according to claim 1, further comprising forming a score to separate a functional section from a non-functional section, wherein the score defines a predetermined breaking line.

11. The method according to claim 1, wherein the first redrawn cup wall adjacent to the first cup base comprises a thread configured to engage a thread of a container.

12. The method according to claim 1, further comprising forming a stiffening bead in the first cup wall adjacent to the open end, wherein the stiffening bead extends over a circumference of the cup wall.

13. The method according to claim 1, wherein one of the first redraw die and a second redraw die comprises a nesting die defining an annular recess adjacent to a radius of the one of the first redraw die and the second redraw die, and wherein one of a first and a second redraw pad comprises an annular surface configured to cooperate with the annular recess to define a gap configured for passage of the metal material to the radius.

14. The method according to claim 1, wherein a first draw reduction from the planar sheet of the metal material to the first redrawn cup is not more than 50%; and a second draw reduction from the first cup to the first redrawn cup is about 20% to 30%; and a third draw reduction from the first redrawn cup to the second redrawn cup is about 15% to 25%.

15. The method according to claim 1, wherein the passing of the material through the ironing die and performing the pinch trim are carried out in a joint processing station that is separate from a processing station for performing at least one of the first redrawing and the second redrawing.

16. The method according to claim 1, further comprising draw forming the first cup from the planar sheet of the metal material defining a first cup flange extending laterally from the first cup wall.

17. The method according to claim 4, wherein the coating extends to an outside of the first cup.

* * * * *